US006840839B2

(12) United States Patent
Rehkemper et al.

(10) Patent No.: US 6,840,839 B2
(45) Date of Patent: Jan. 11, 2005

(54) INTERACTIVE BATTLING ROBOTS WITH UNIVERSAL VEHICLE CHASSIS

(75) Inventors: Jeffrey G. Rehkemper, Chicago, IL (US); Peter A. Greenley, Chicago, IL (US); Ryan H. Kratz, Chicago, IL (US); Nicholas J. Grisolia, Chicago, IL (US); Michael M. Kass, Willowbrook, IL (US); Edward Daniel Polanek, Spring Grove, IL (US); Benjamin R. Durbin, Lombard, IL (US)

(73) Assignee: Hasbro, Inc., Pawtucket, RI (US)

( * ) Notice: Subject to any disclaimer, the term of this patent is extended or adjusted under 35 U.S.C. 154(b) by 105 days.

(21) Appl. No.: 10/056,676

(22) Filed: Jan. 25, 2002

(65) Prior Publication Data

US 2002/0160688 A1 Oct. 31, 2002

Related U.S. Application Data

(60) Provisional application No. 60/266,958, filed on Feb. 6, 2001.

(51) Int. Cl.[7] ..... A63H 30/00
(52) U.S. Cl. ..... 446/454; 446/484
(58) Field of Search ..... 446/454, 484, 446/88, 71, 90, 91, 441, 443, 448, 456, 465, 93, 94

(56) References Cited

U.S. PATENT DOCUMENTS

| | | | | |
|---|---|---|---|---|
| 1,547,516 A | | 7/1925 | Neff | |
| 1,973,220 A | | 9/1934 | Mohr | |
| 2,587,142 A | | 2/1952 | Gray et al. | |
| 4,183,173 A | | 1/1980 | Ogawa | |
| 4,248,006 A | | 2/1981 | Jones et al. | |
| 4,530,670 A | | 7/1985 | Ohno | |
| 4,631,040 A | | 12/1986 | Shiraishi | |
| 4,895,542 A | | 1/1990 | de Blanitza | |
| 4,938,483 A | * | 7/1990 | Yavetz | 273/311 |
| 4,993,983 A | | 2/1991 | Kurita et al. | |
| 5,046,981 A | | 9/1991 | Roddy | |
| 5,135,427 A | * | 8/1992 | Suto et al. | 446/433 |
| 5,292,275 A | | 3/1994 | Swisher et al. | |
| 5,322,469 A | * | 6/1994 | Tilbor | 446/454 |
| 6,439,956 B1 | * | 8/2002 | Ho | 446/454 |

FOREIGN PATENT DOCUMENTS

| | | |
|---|---|---|
| GB | 1 005 849 | 9/1965 |
| GB | 1 357 517 | 6/1974 |

* cited by examiner

*Primary Examiner*—Derris H. Banks
*Assistant Examiner*—Jamila O Williams
(74) *Attorney, Agent, or Firm*—Michael Best & Friedrich LLP

(57) ABSTRACT

A universal chassis which may be assembled with modular componentry allowing for a play pattern with the user in which modification of the overall construction of the vehicle is encouraged. The modularity is purposely built in to allow users to modify their Battlebot chassis. In operating the configured vehicle, two motors, i.e., left and right, are provided with pulsed controlled operation to facilitate two-speed performance. The ability to transmit/receive IR signals modulated on one or more of multiple carriers facilitates the play pattern with simultaneous operation of multiple vehicles. An impact sensor or the like provides for detecting impacts, and processor control may be used for counting impacts in order to modify the functionality accorded to the user with the universal chassis. The mechanical subassemblies (such as weaponry providing a play pattern as between remote control vehicles operable simultaneously such that overall functionality) may be removed or limited based on collisions or damages taken on by the vehicles.

13 Claims, 43 Drawing Sheets

22

R12
C9
U5
AMP OUT
3
IN
OUT
8
C10
2
OFILT
5
LFILT
6
TRES
TCAP
C11
R15
D3
TG3
TG3
STPA
STPB
STPD
STPE
STPF
C13
25
MICROPROCESSOR
STPA
1
2
U3A
3
AA
STPE
U4
4
R
2
TR
Q
3
D2
7
DIS
5
CV
THR
6
R13
STPB
4
5
U3B
6
BB
STPD
9
10
U3C
8
CC
R14
STPF
12
13
U3D
11
DD
C12

INTERACTIVE BATTLING ROBOTS WITH UNIVERSAL VEHICLE CHASSIS

CROSS-REFERENCE TO RELATED APPLICATION

This application claims benefit of U.S. Provisional Application No. 60/266,958, filed Feb. 6, 2001.

BACKGROUND OF THE INVENTION

The present invention relates to infrared (IR) remote control vehicles having multiple body styles operable with a universal chassis with attachable dynamic assemblies, and more particularly to robotic vehicles that can accept one or more different weapon assemblies operable from the drive motors of the universal chassis.

It would be desirable to provide a modular chassis system for children facilitating the customization or modification of overall vehicle designs and allowing for the configuration of robotic vehicles which may include mechanical subassemblies such as weaponry providing a play pattern as between remote control vehicles operable simultaneously such that overall functionality may be removed or limited based on collisions or damages taken on by the vehicles.

SUMMARY OF THE INVENTION

Briefly summarized, the present invention provides a universal chassis which may be assembled with modular componentry allowing for a play pattern with the user in which modification of the overall construction of the vehicle is encouraged. There is a desire therefore to provide for the ability to accept a variety of snap-on components. In operating the configured vehicle, two motors, i.e., left and right, are provided with pulsed controlled operation to facilitate two-speed performance. The ability to transmit/receive IR signals modulated on one or more of multiple carriers facilitates the play pattern with simultaneous operation of multiple vehicles. An impact sensor or the like provides for detecting impacts, and processor control may be used for counting impacts in order to modify the functionality accorded to the user with the universal chassis.

Advantageously, snap-on mechanical subassemblies may be powered from either of the two motors of the universal chassis such that operation of either motor may operate the snap-on mechanical subassembly which may be provided as a weapon or the like as use by the robotic vehicle. The controller onboard the chassis controls all functionality of the chassis and may also provide for the detection of the presence or absence of any mechanical subassemblies. Additionally, interlocks or clutch mechanisms may be provided with the mechanical subassemblies for safety and reliability of the configured vehicles.

BRIEF DESCRIPTION OF THE DRAWINGS

A better understanding of the present invention is obtained when considered in connection with the following description, drawings and software Appendix (A-1 through A-8), in conjunction with the following figures, in which:

FIGS. 2A–2J, FIGS. 3A–3C and 3E–3J, FIGS. 4A–4J, and FIGS. 5A–5J respectively illustrate four (4) robotic vehicle embodiments illustrating various subassemblies corresponding to associated assemblies as between the embodiments of the FIGS. 2–5, with a total assembly illustrated as (A) and subassemblies (B)–(J);

FIGS. 7A–7D are schematic diagrams of the electronic circuitry in the universal chassis in which FIGS. 7A and 7B shows the IR receiver circuitry and FIGS. 7C and 7D shows the H bridge motor control circuitry for the chassis motors in which FIG. 7C controls the left-hand motor and FIG. 7D controls the right-hand motor.

With reference to FIG. 1, the universal chassis 10 for the preferred embodiments is provided as an IR controlled vehicle chassis which facilitates multiple functionality including the provision of a dual motor, dual speed, remote control vehicles 1 that accommodate multiple modular wheel 12, weapon 14 and body 16 assemblies which may be received on the universal chassis 10 of FIG. 1. As described, the chassis 10 is further equipped with on-board electronics 22 for receiving encoded IR signals for controlling the speed of the left-hand 18 and right-hand 20 motors respectively, and microprocessor control is provided for counting the number of physical impacts as identified with an impact switch 24 or tilt sensor.

Figure 1:
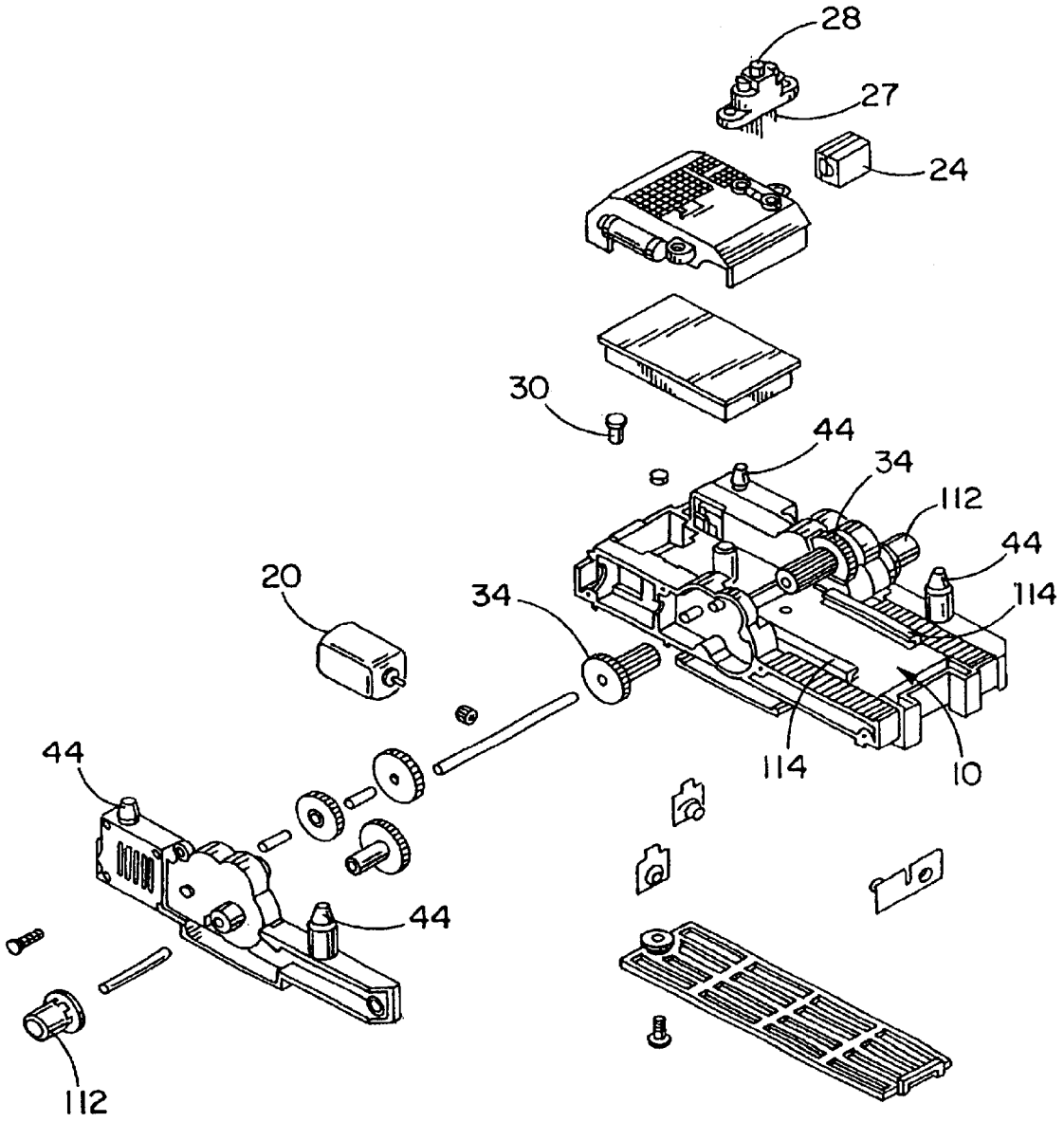
FIG. 1 illustrates an exploded view of a basic universal chassis in accordance with the present invention.
Figure 2A:
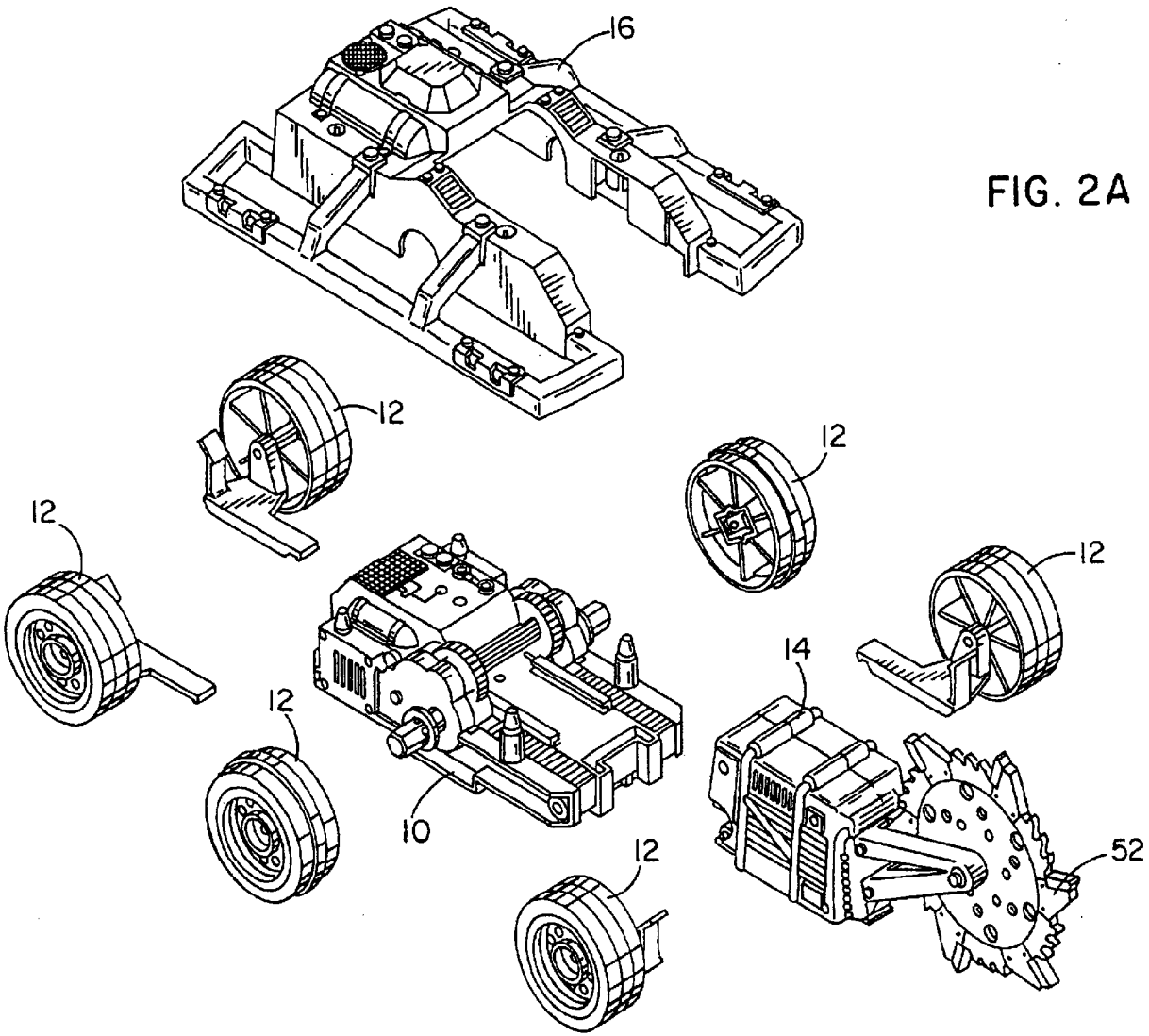
Figure 2B:
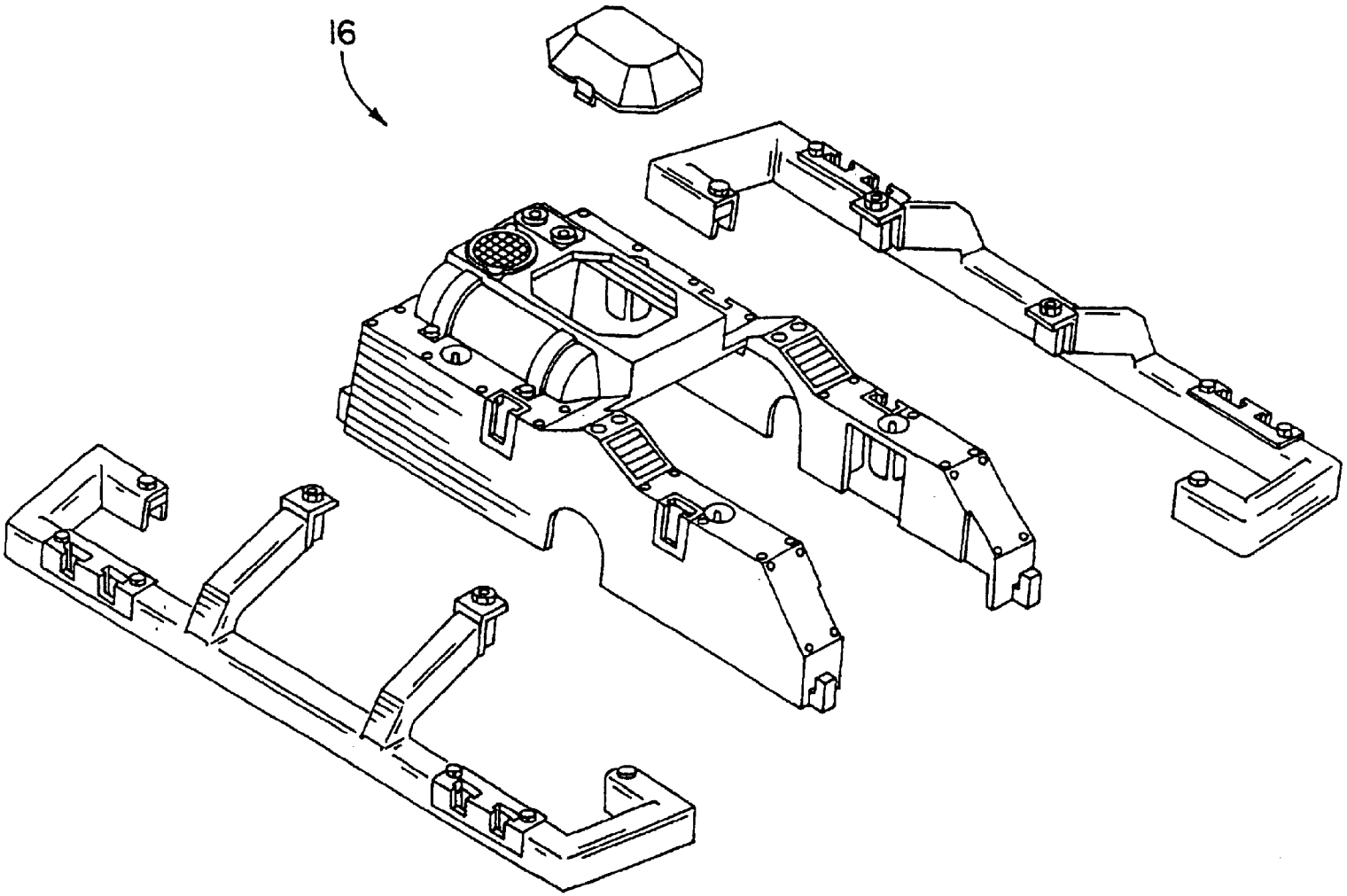
Figure 2C:
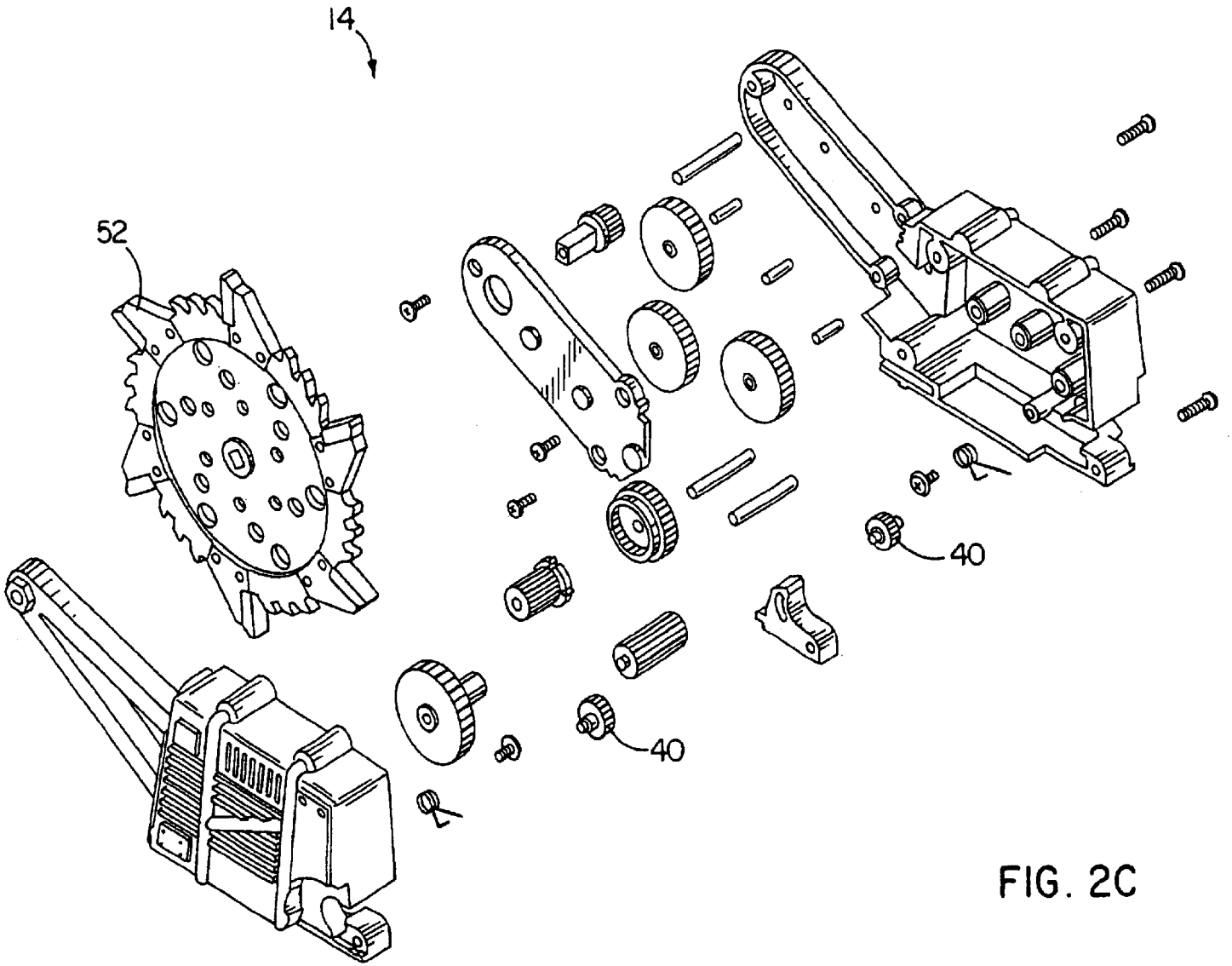
Figure 2D:
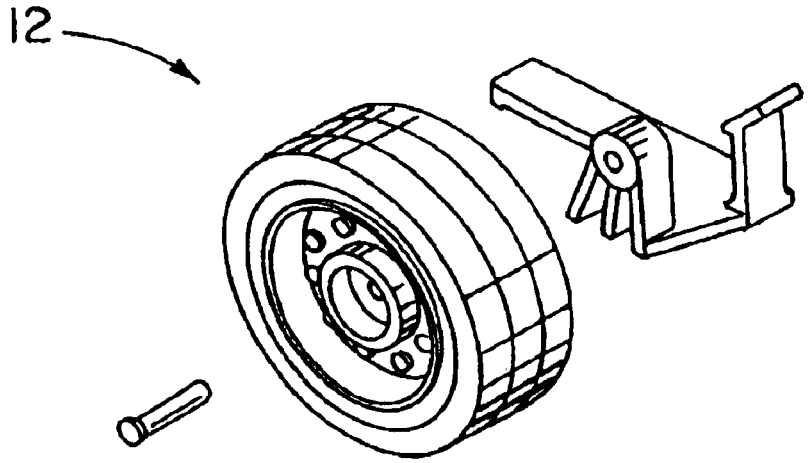
Figure 2F:
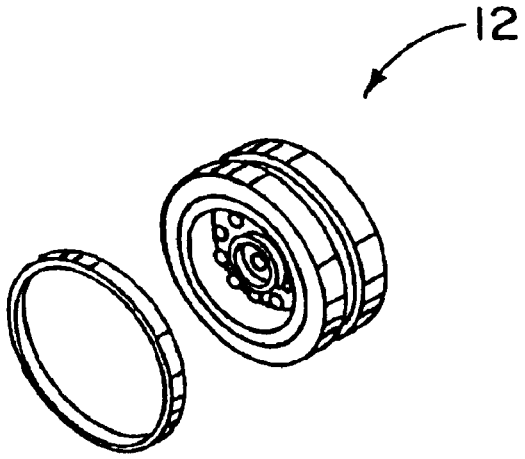
Figure 2E:
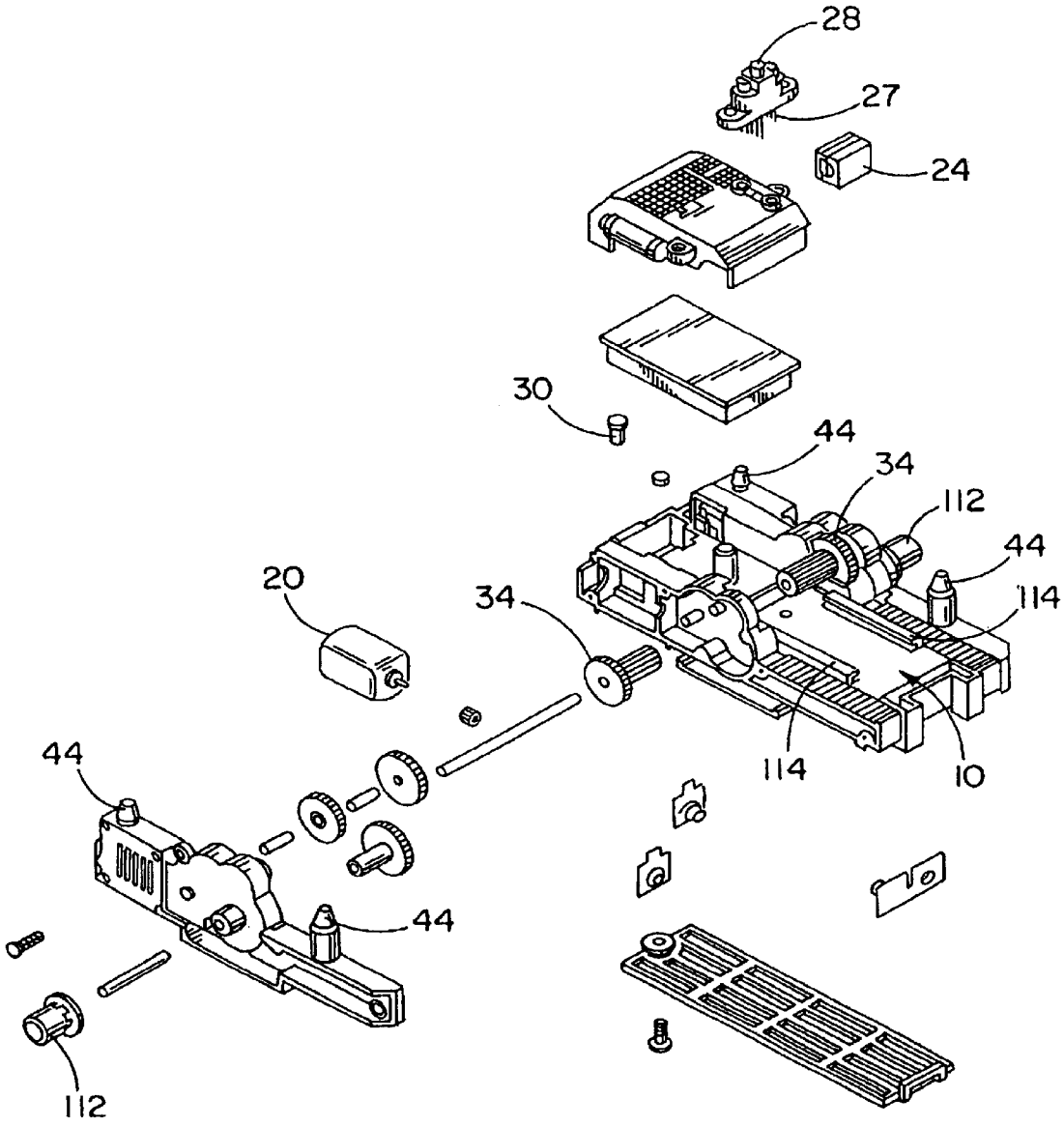
Figure 2G:
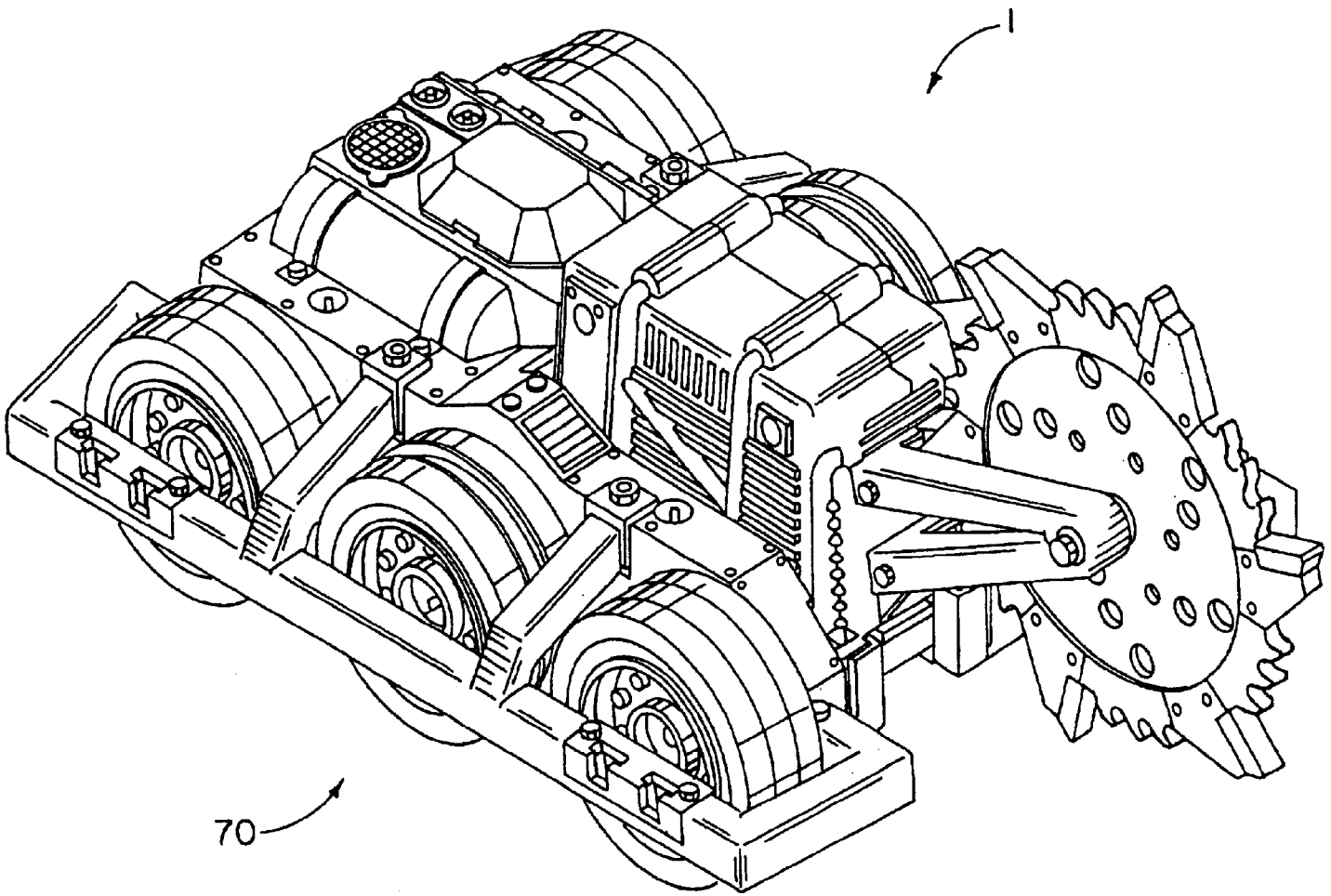
Figure 2H:
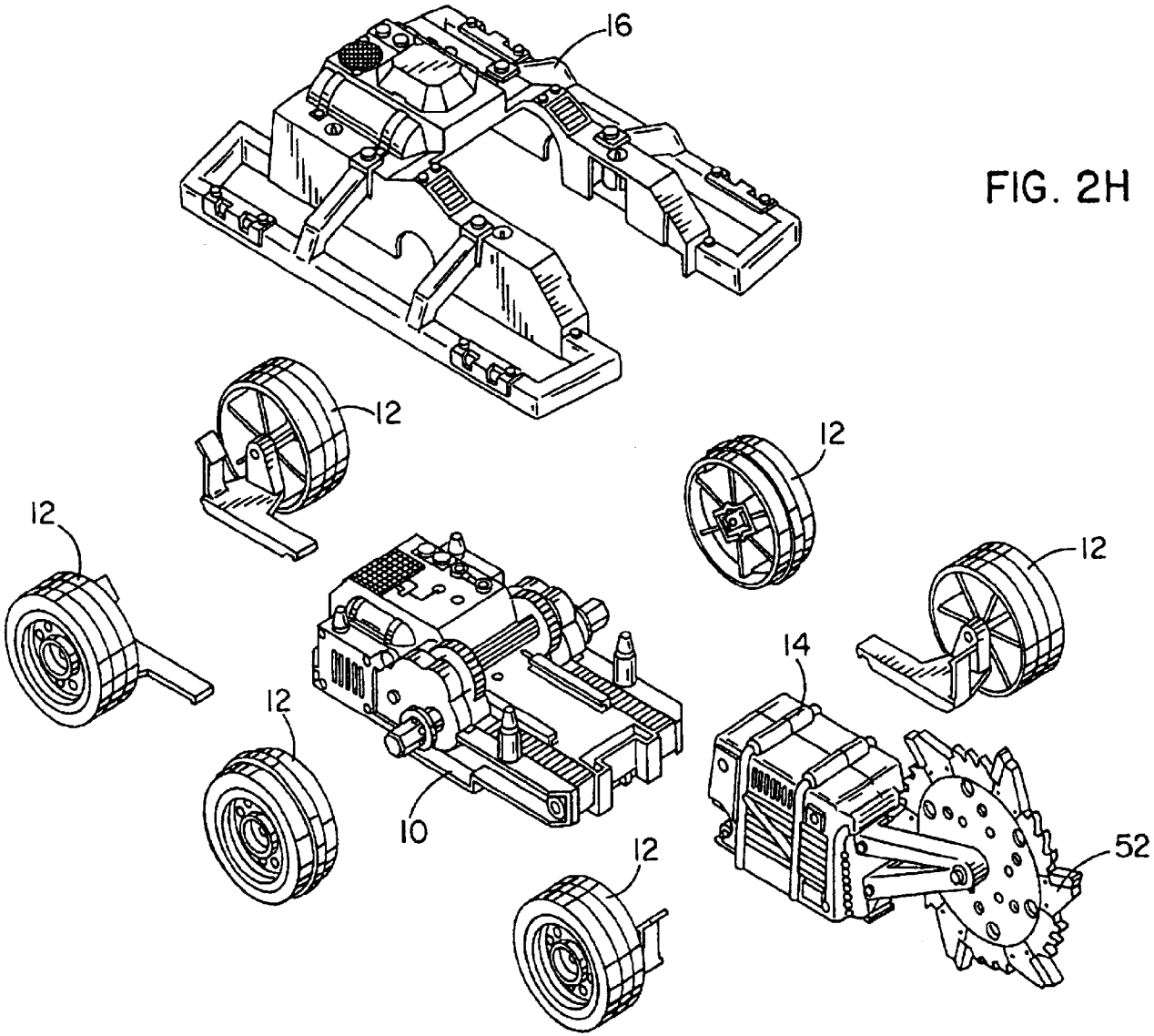
Figure 21:
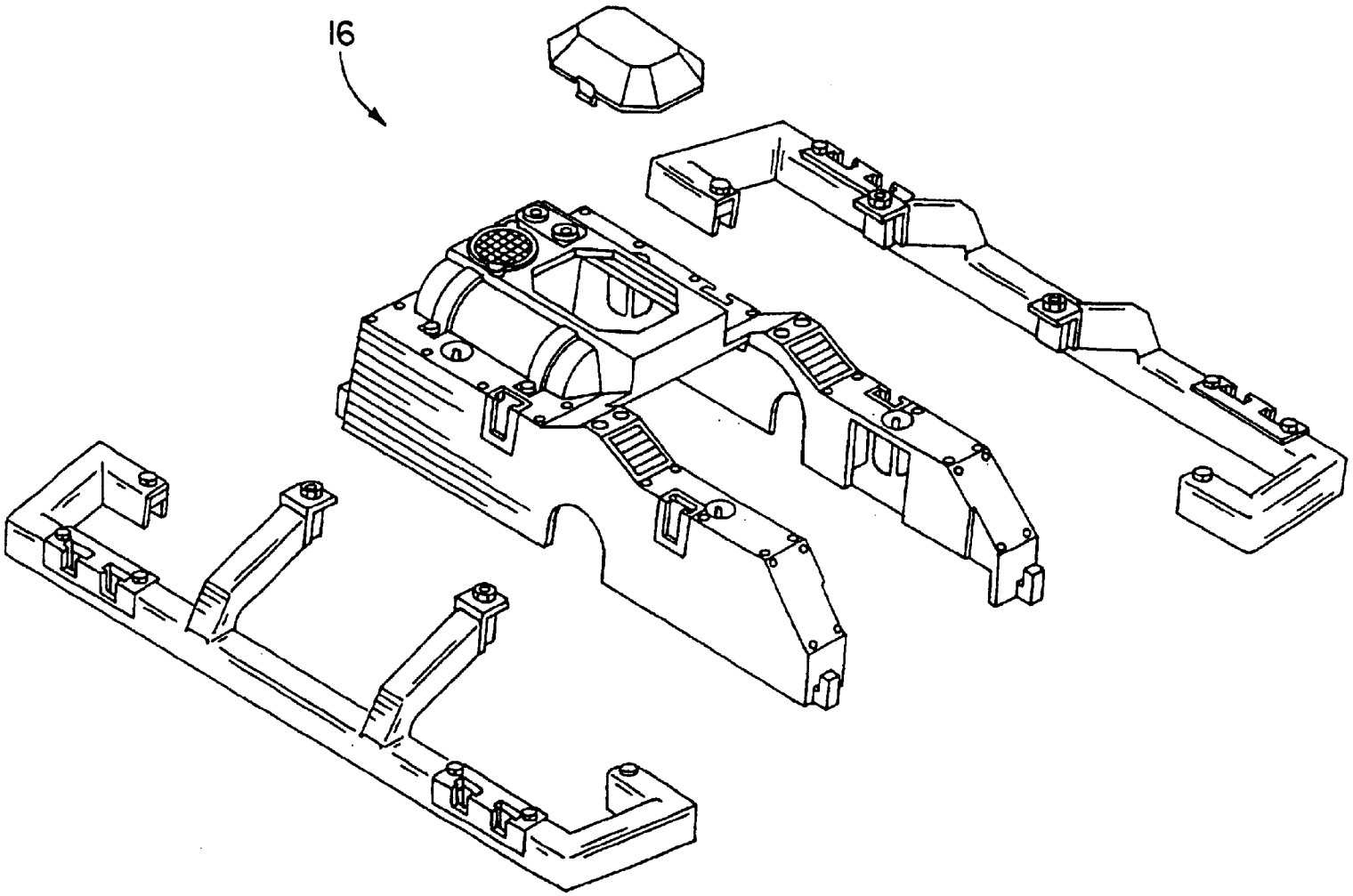
Figure 2J:
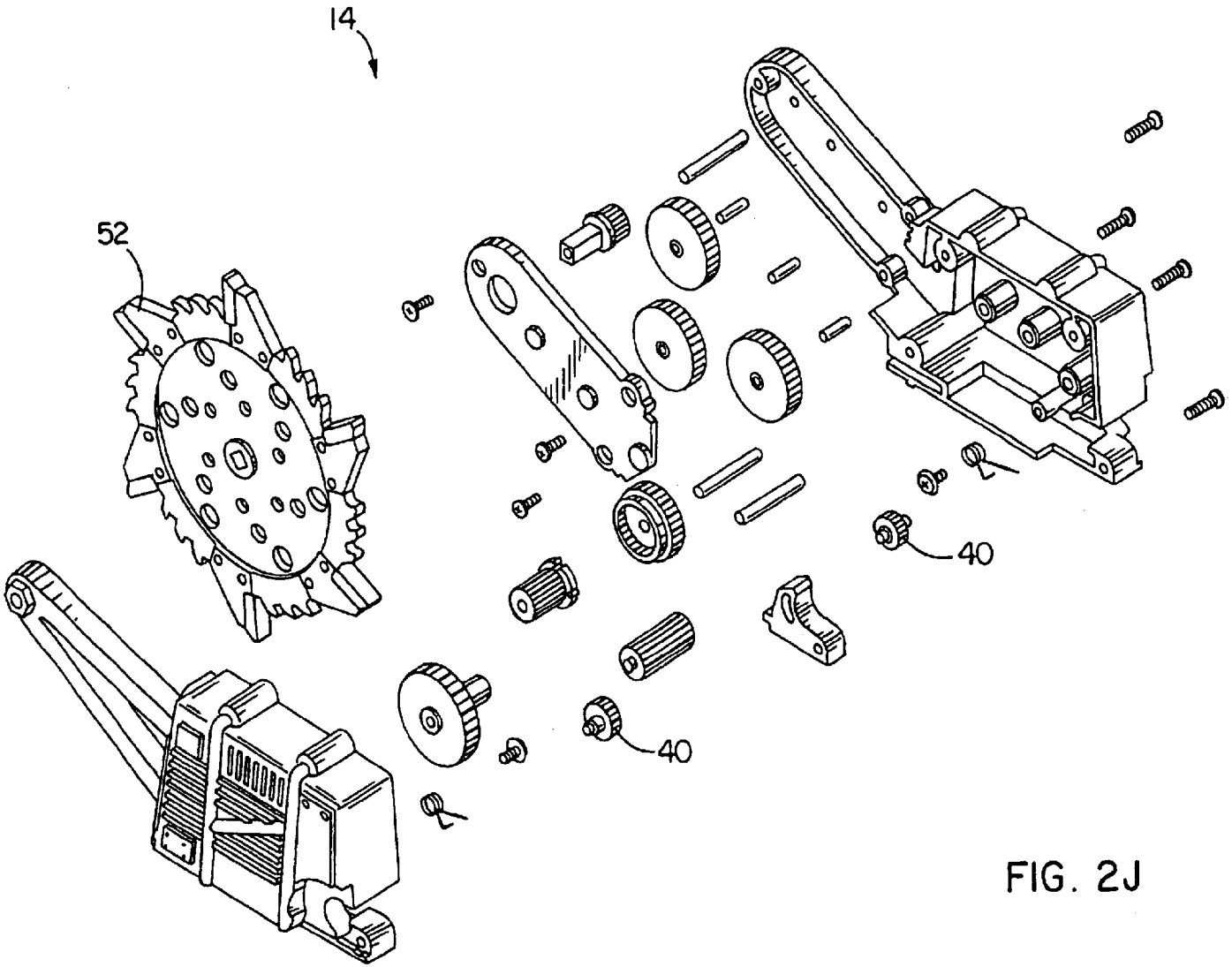
Figure 3A:
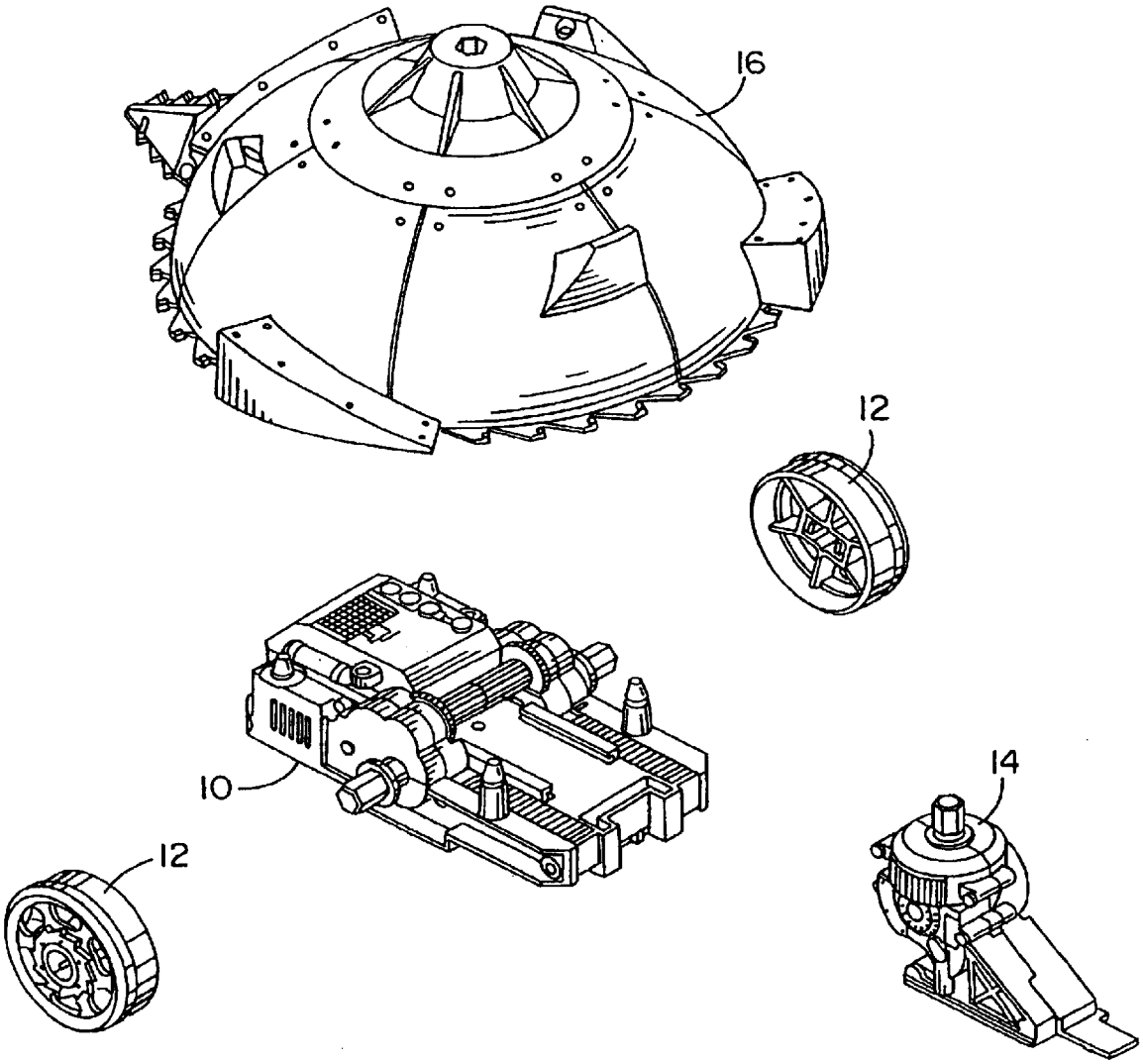
Figure 3B:
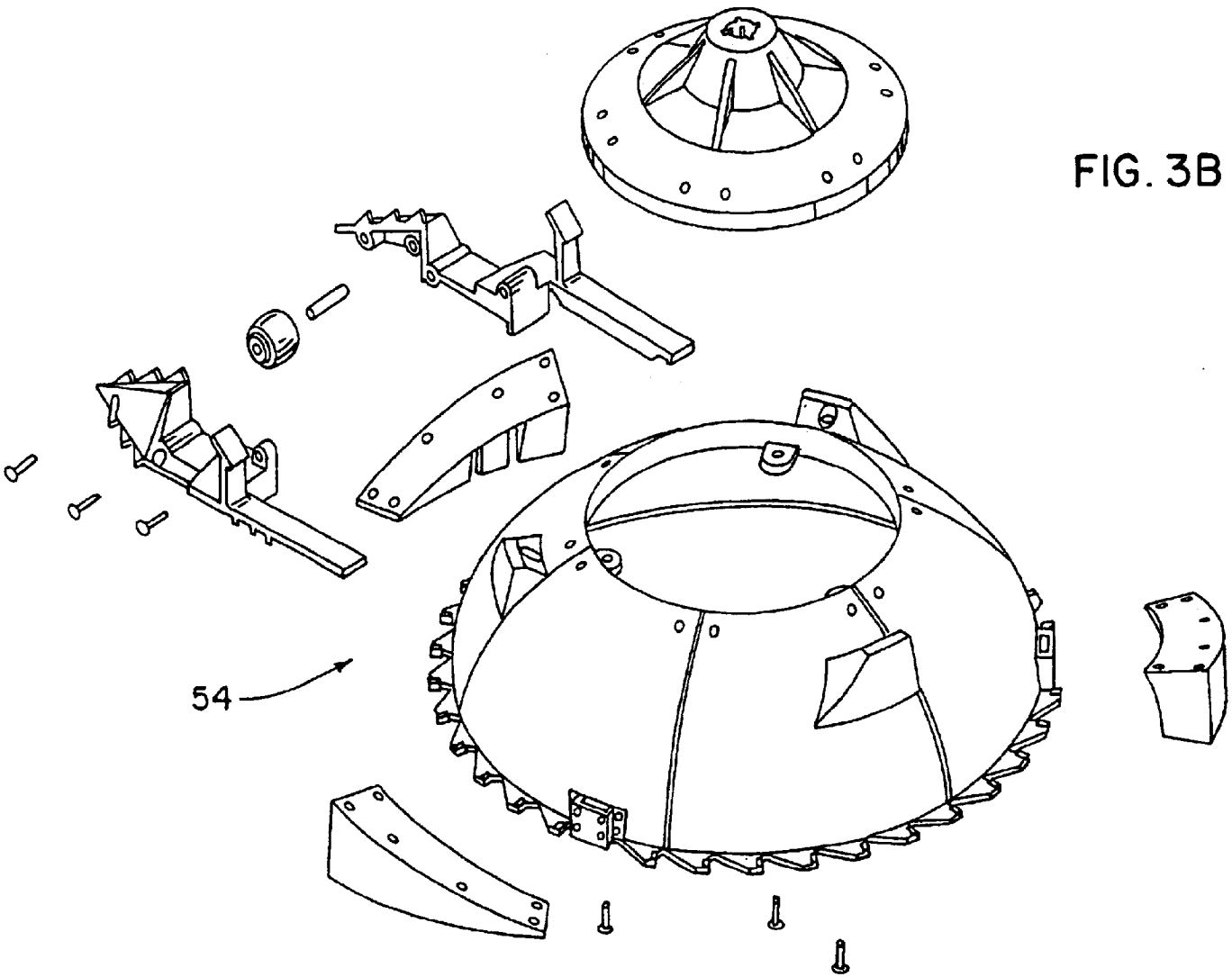
Figure 3C:
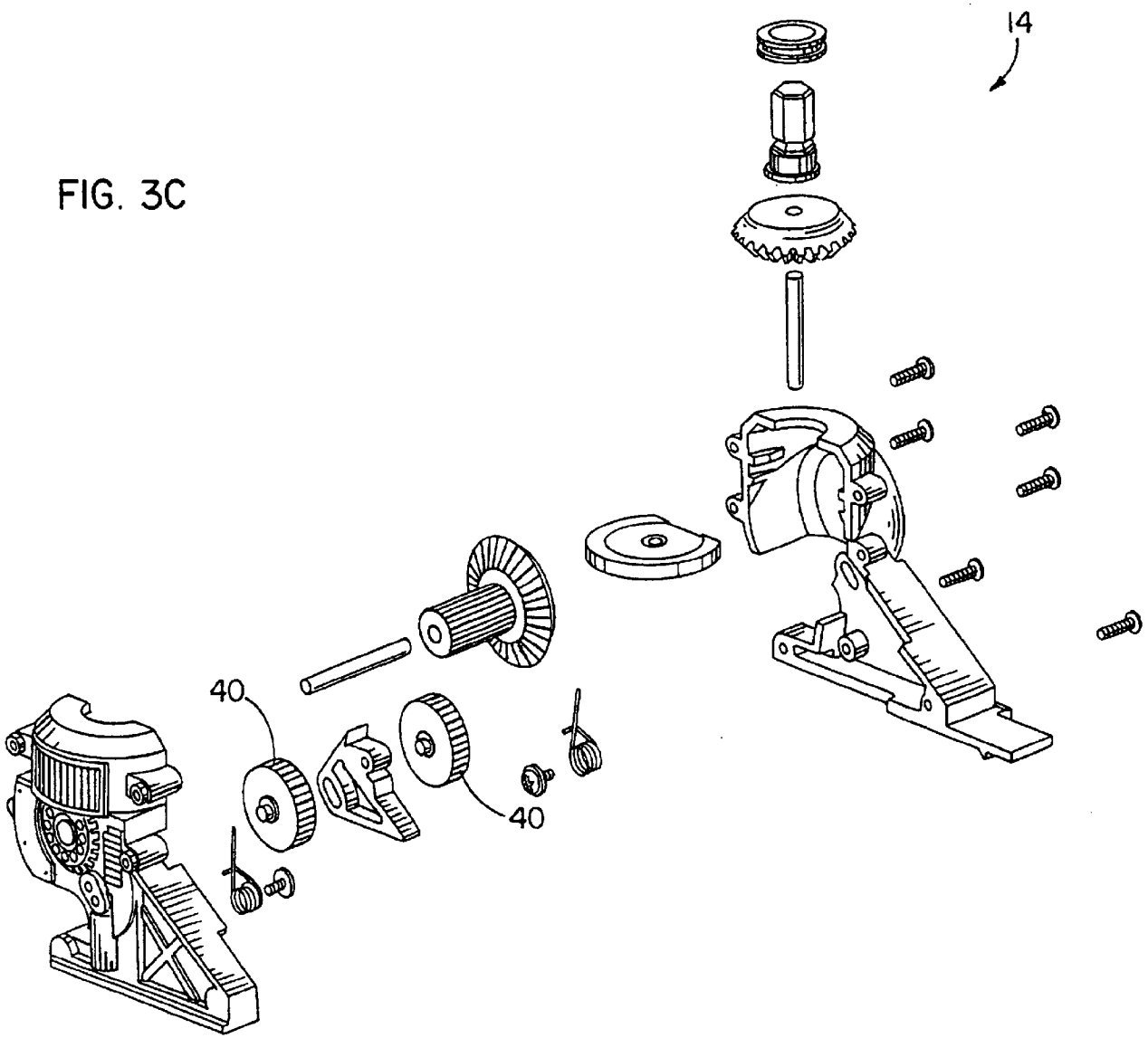
Figure 3F:
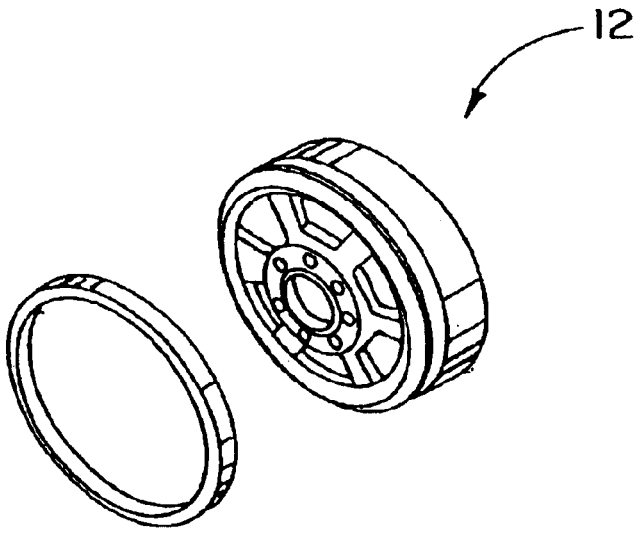
Figure 3D:
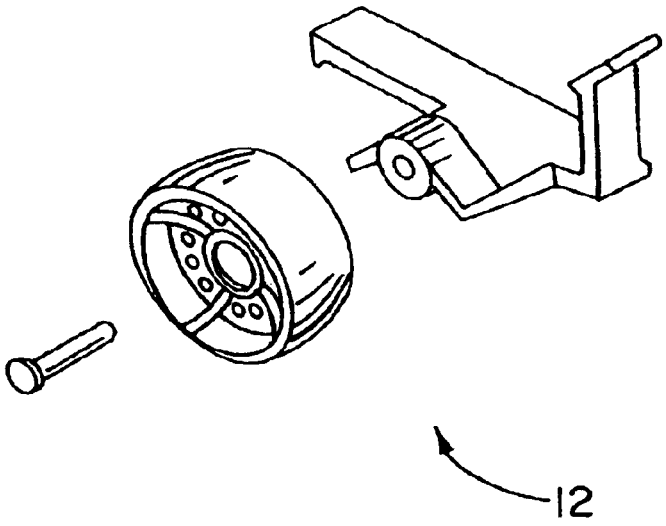
Figure 3E:
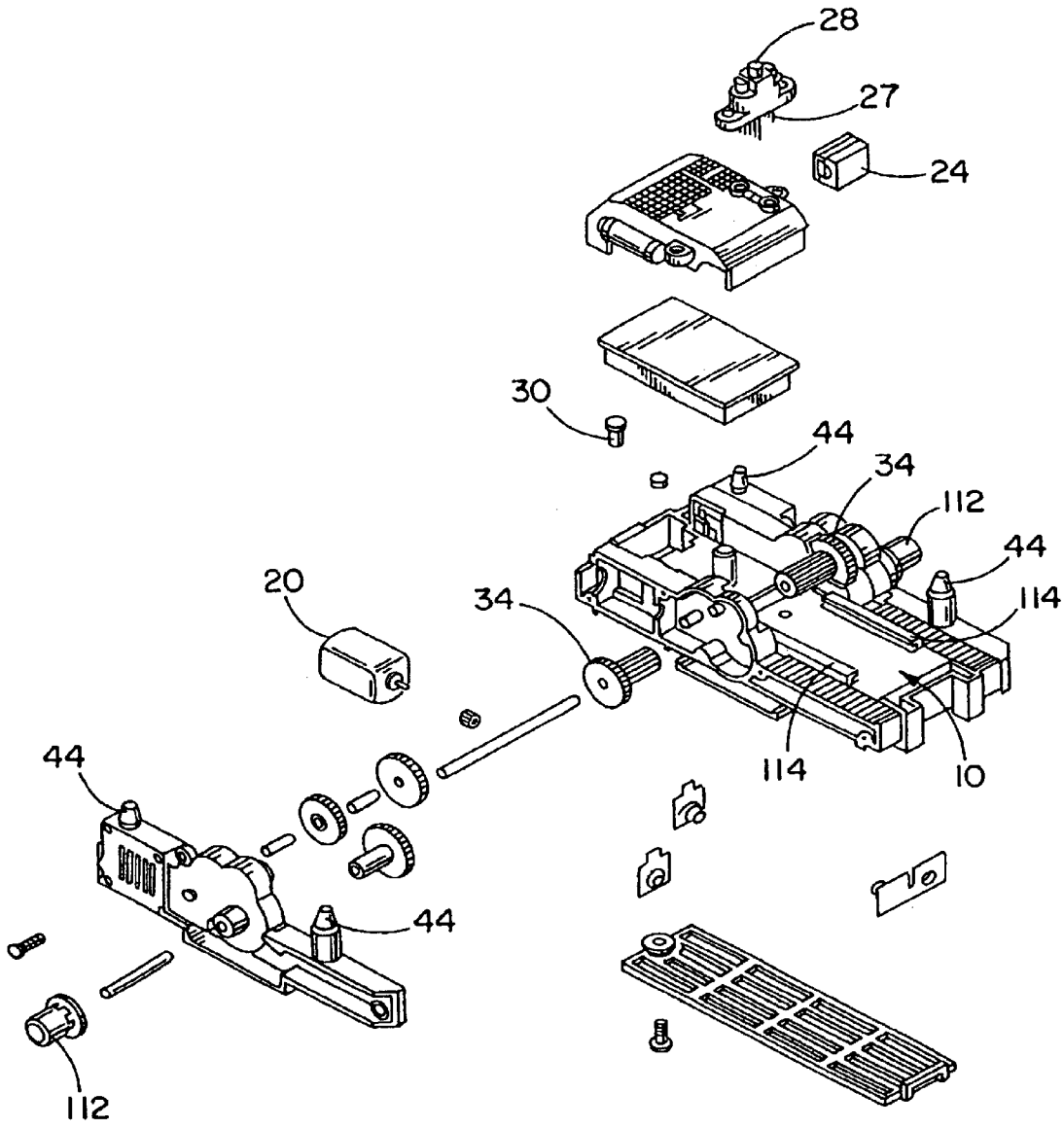
Figure 3G:
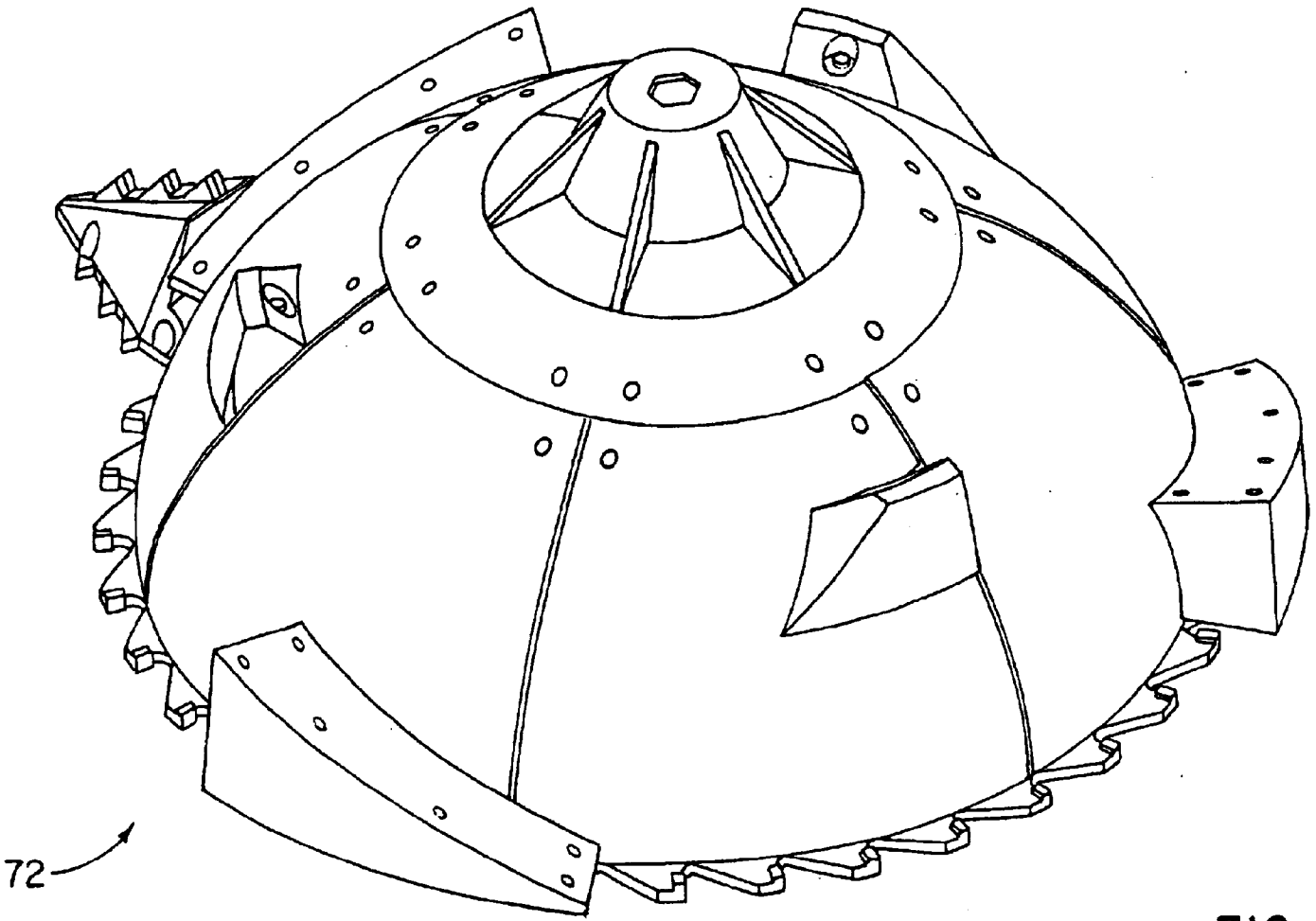
Figure 3H:
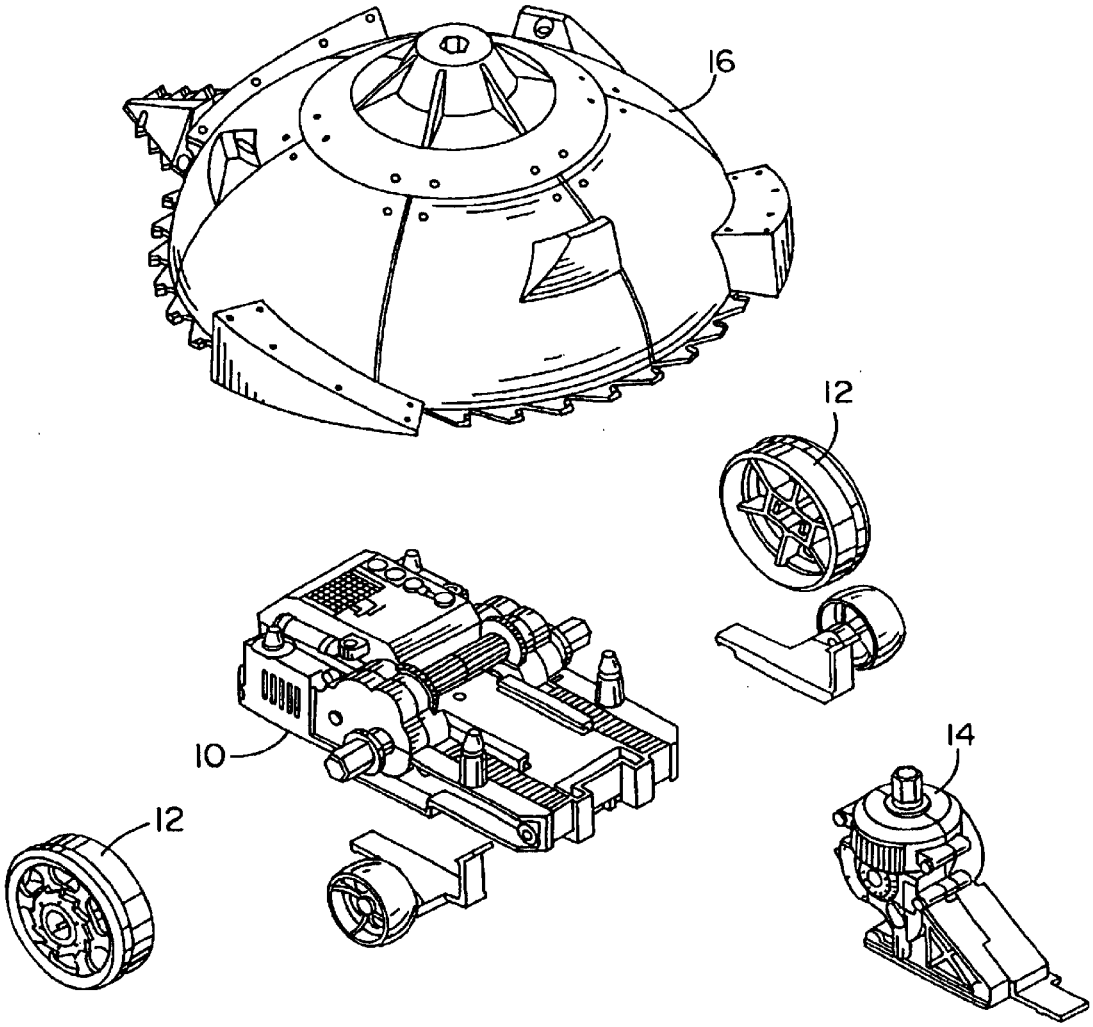
Figure 3I:
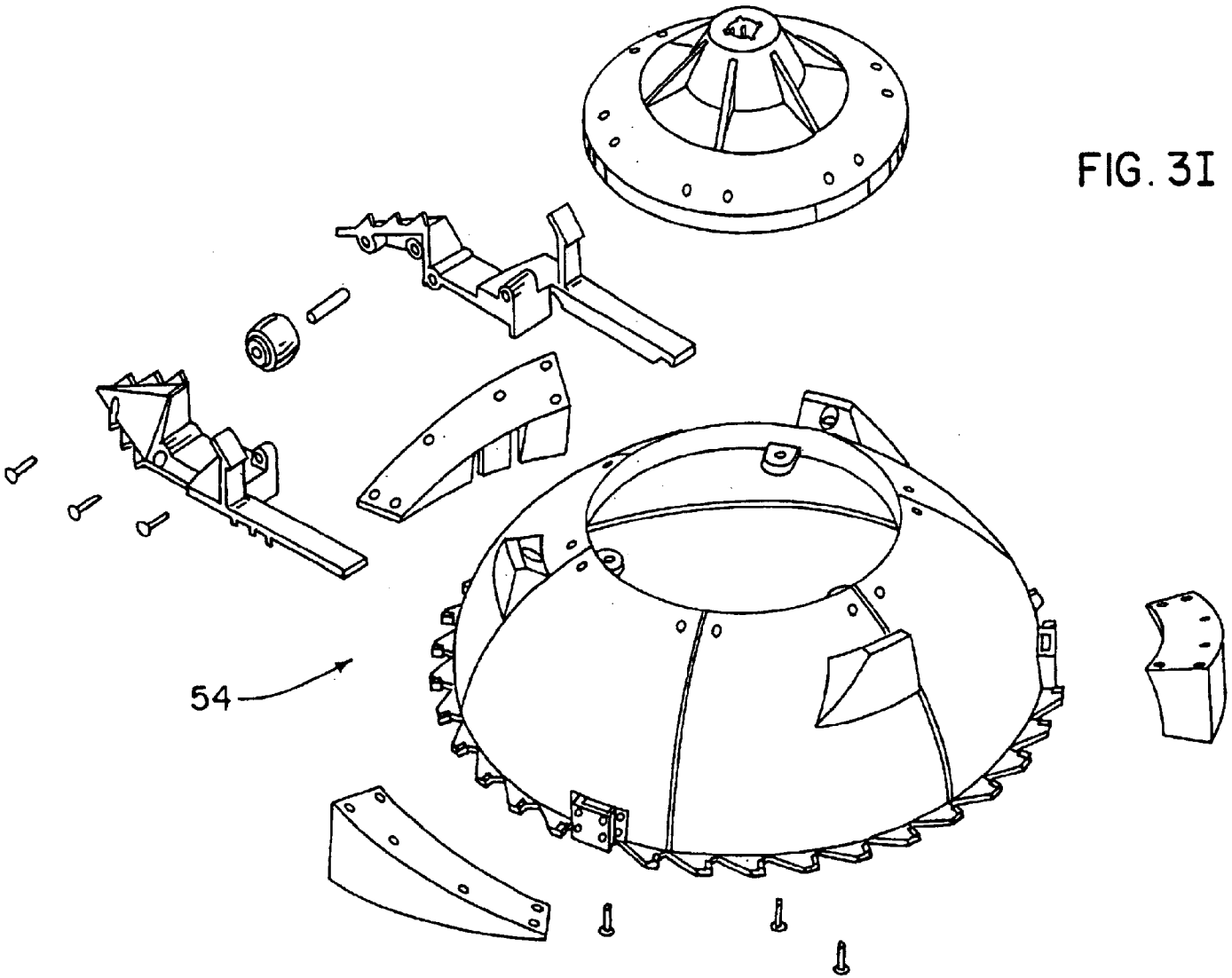
Figure 3J:
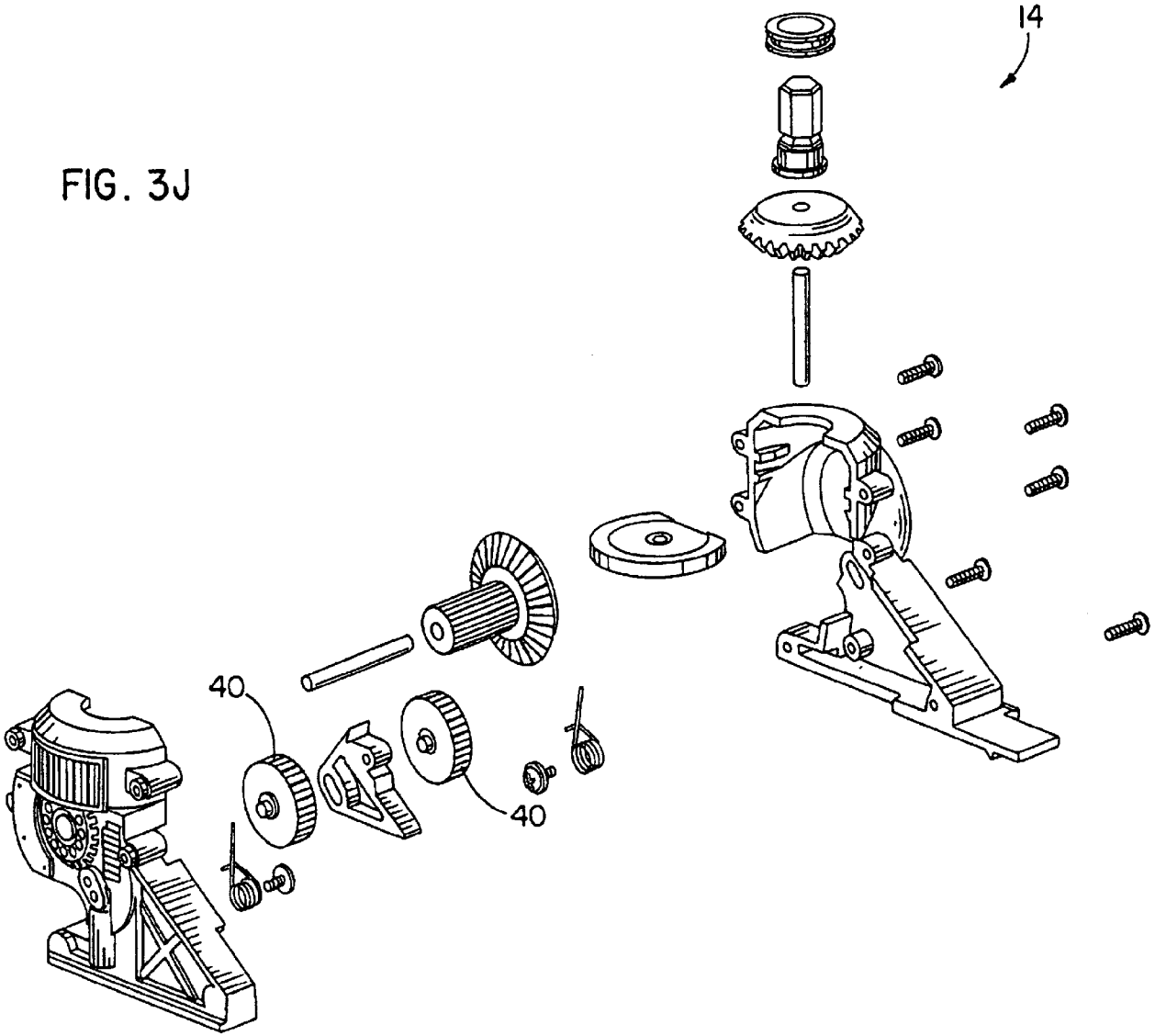
Figure 4A:
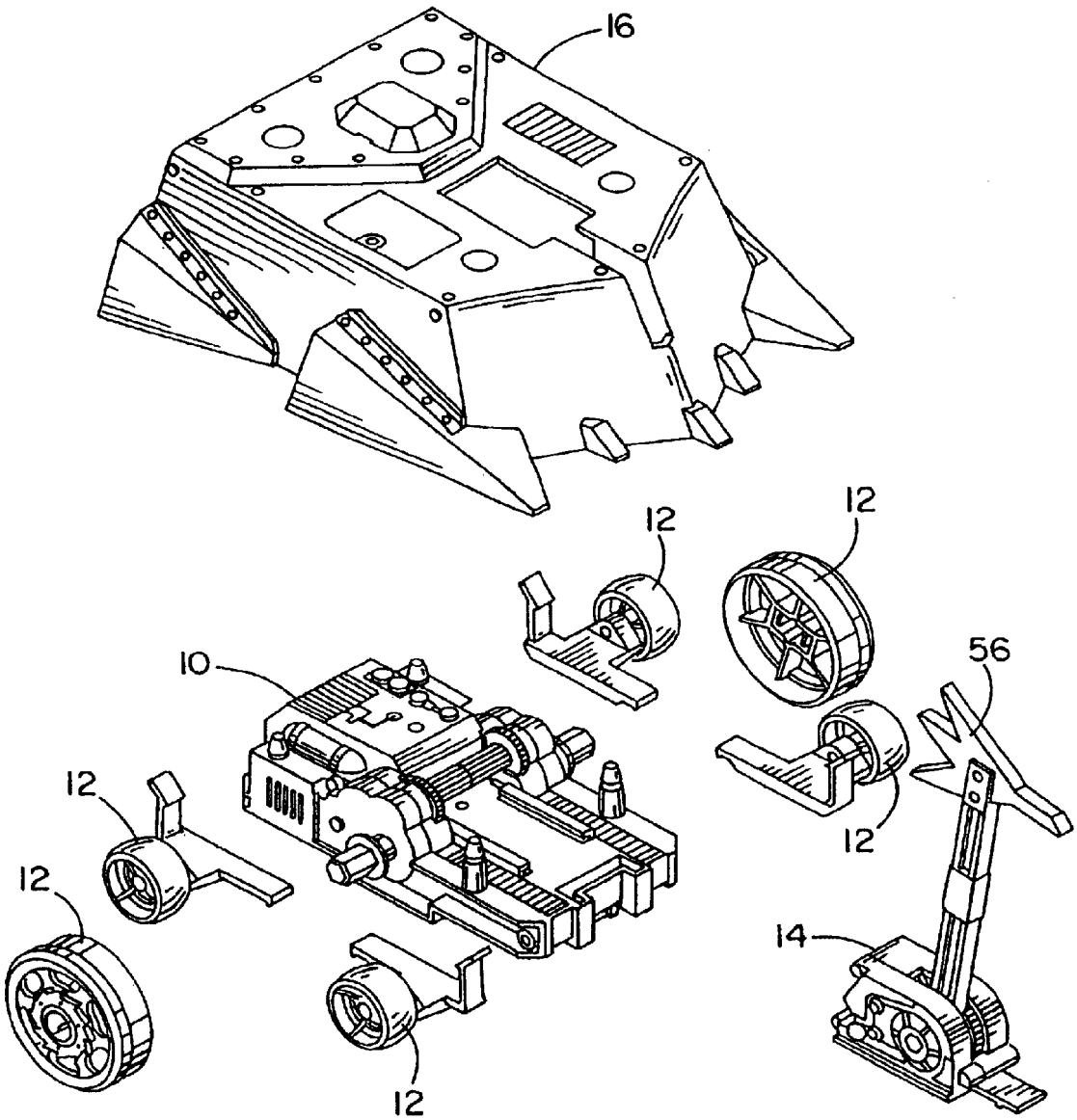
Figure 4B:
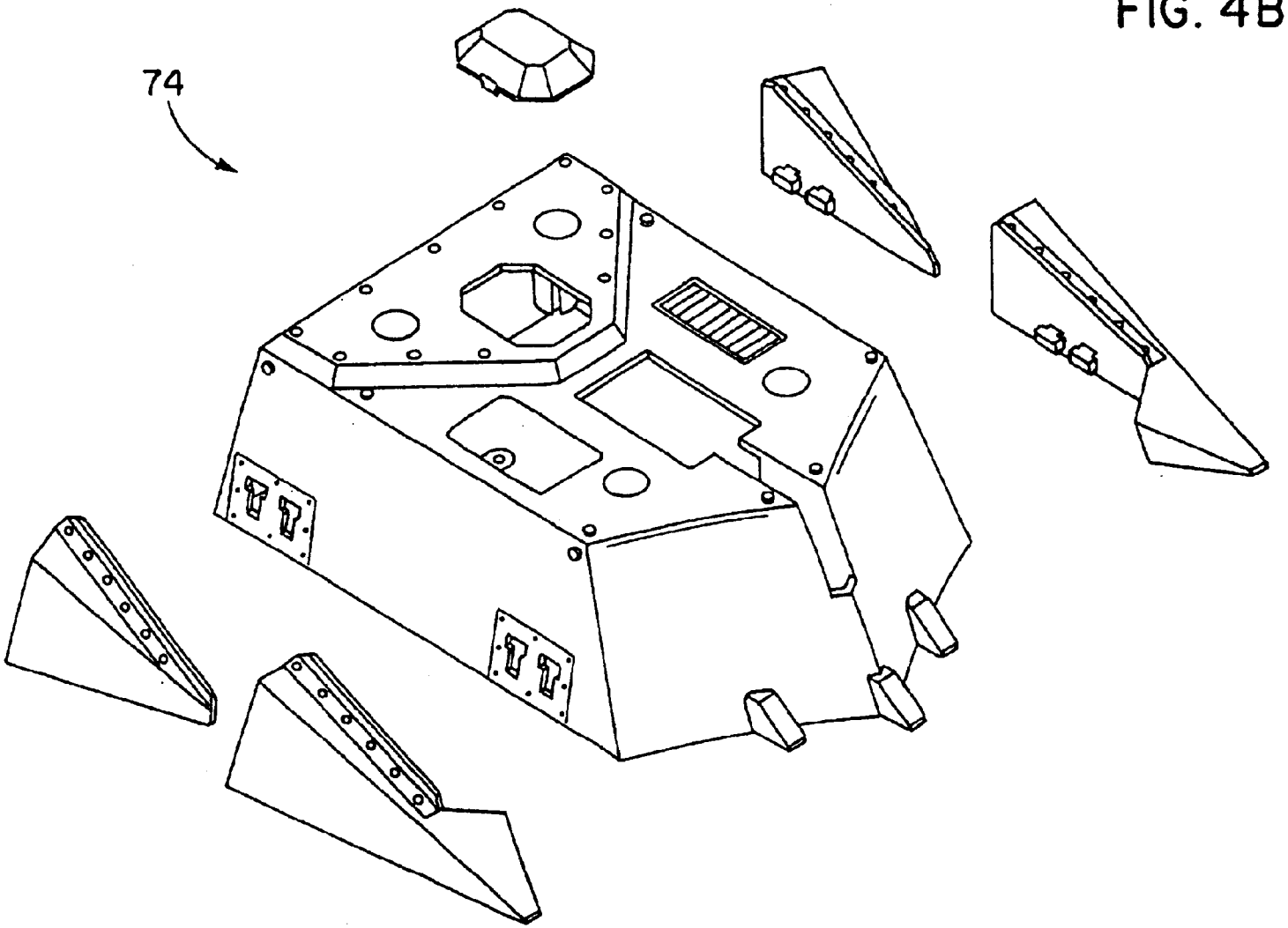
Figure 4C:
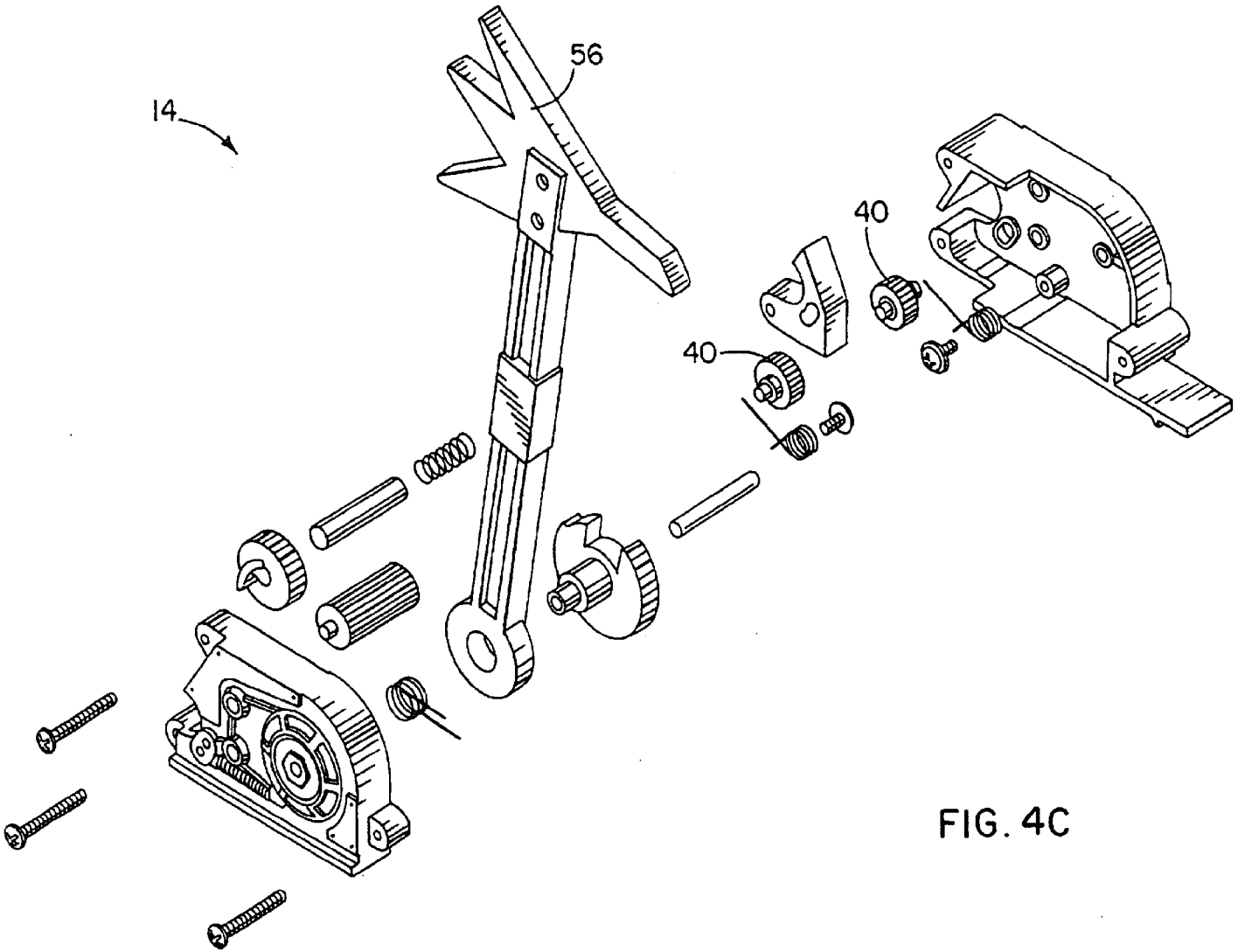
Figure 4D:
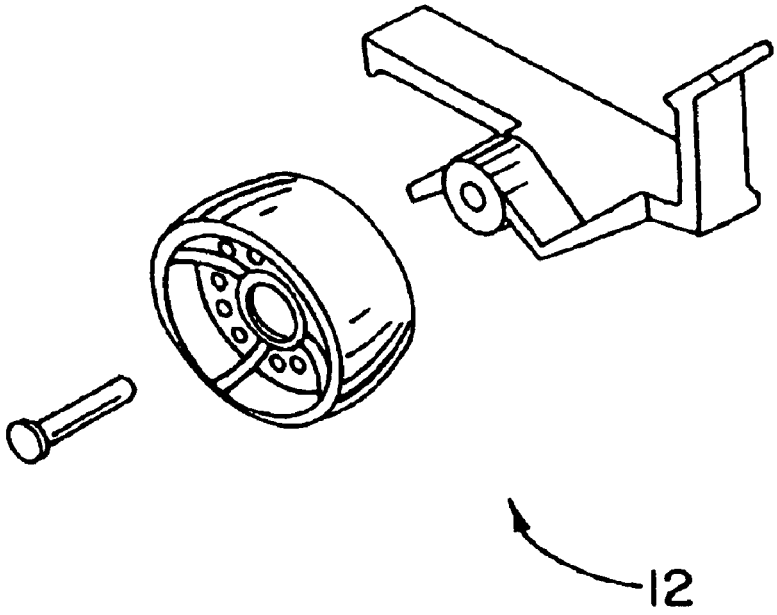
Figure 4E:
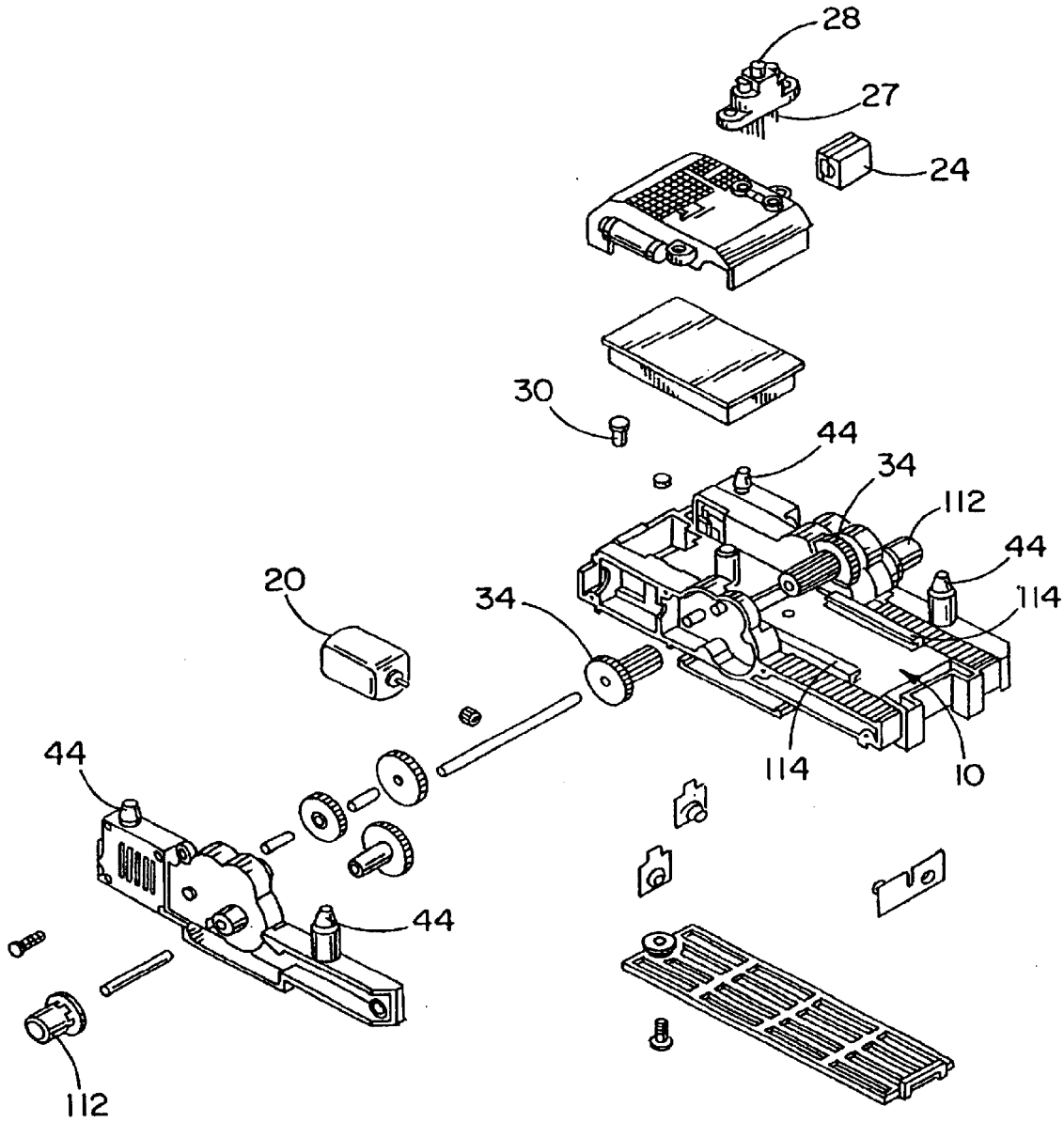
Figure 4F:
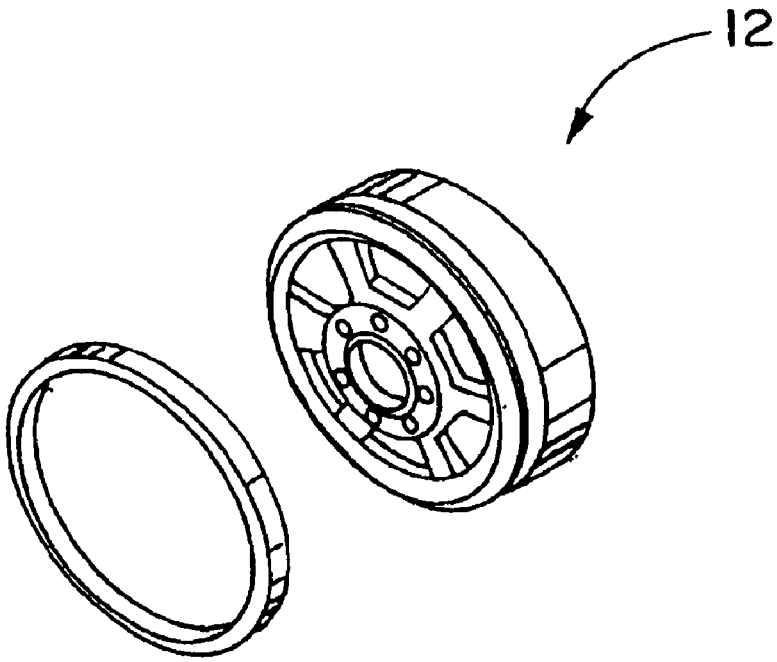
Figure 4G:
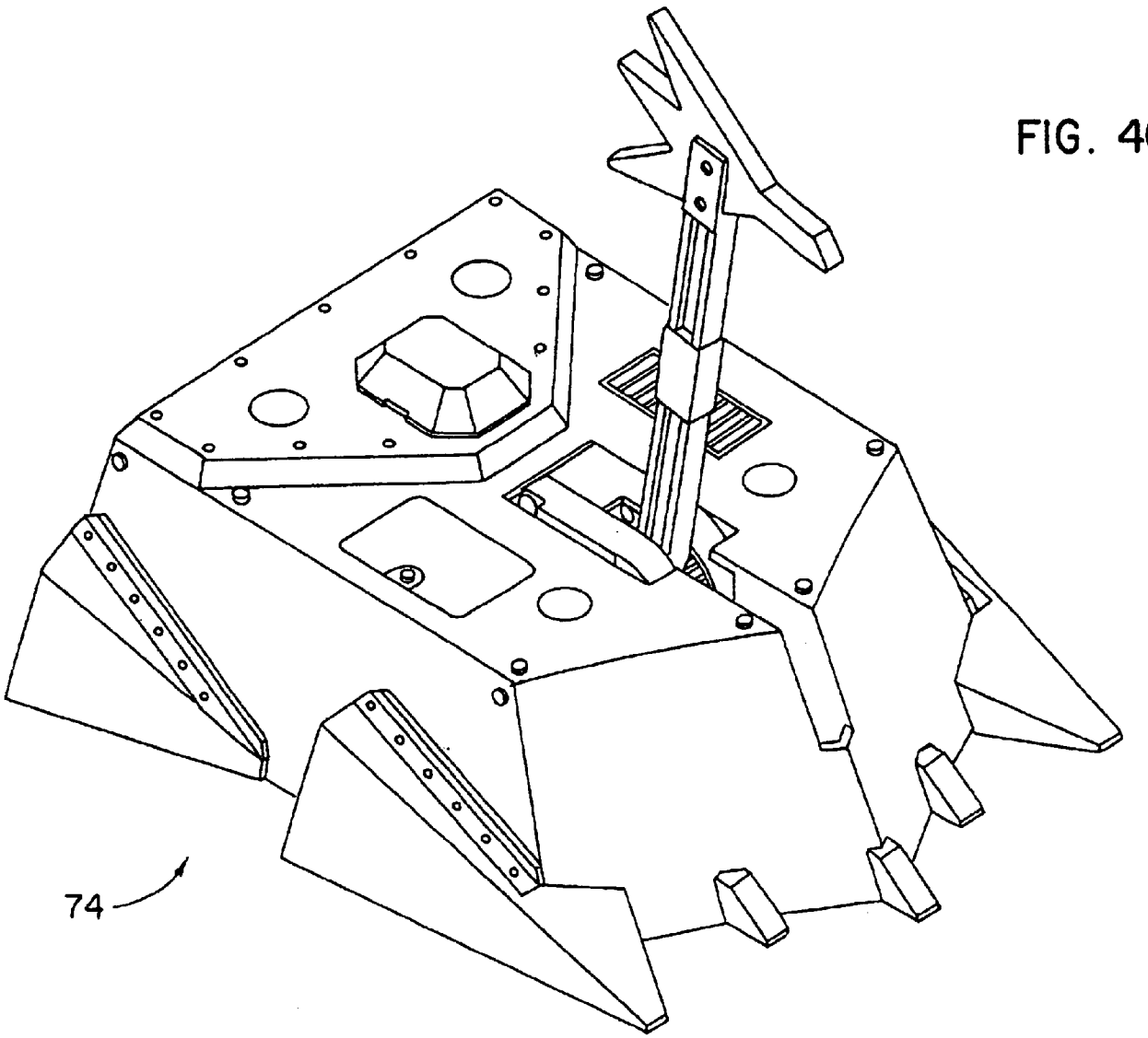
Figure 4H:
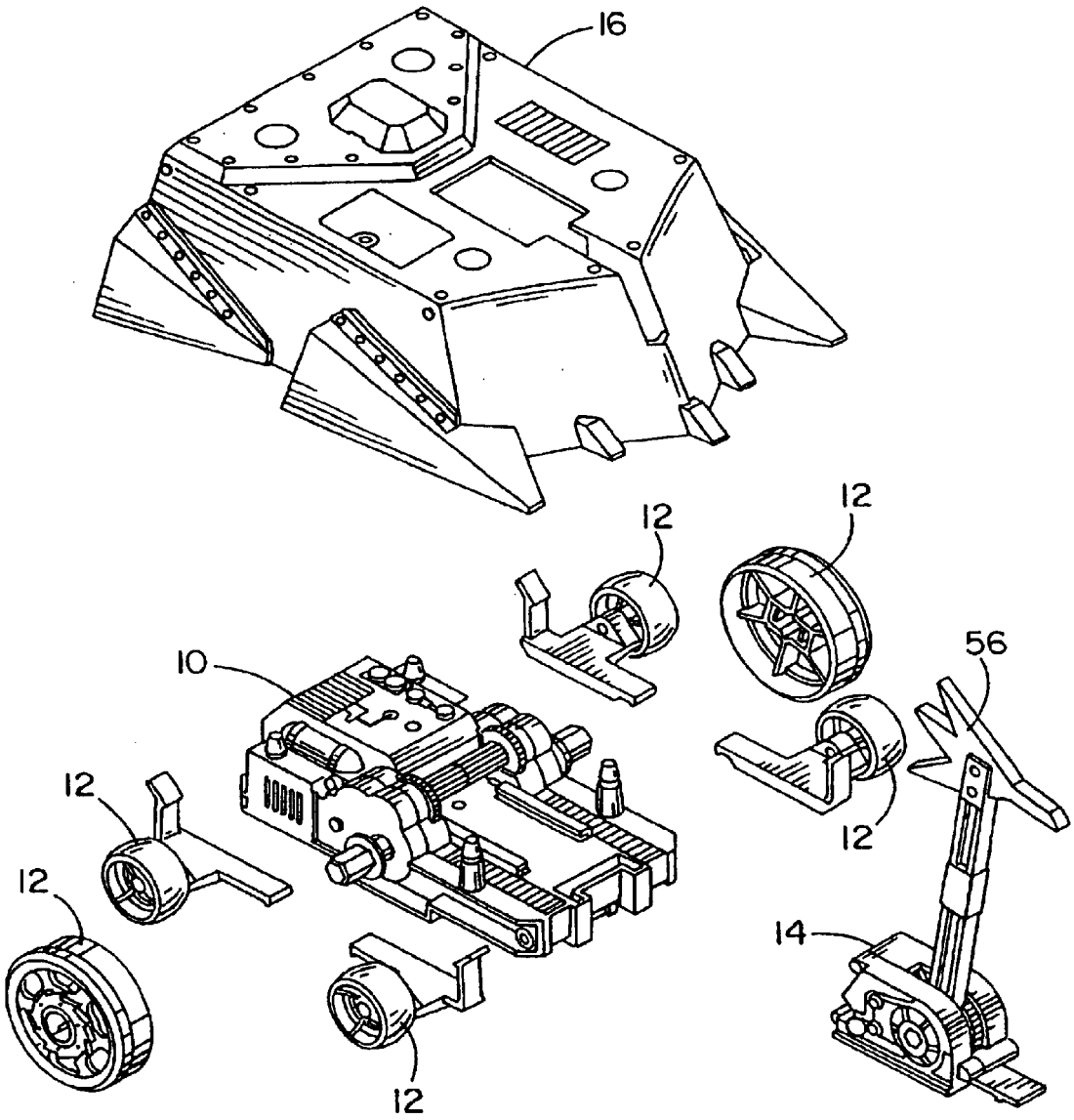
Figure 4I:
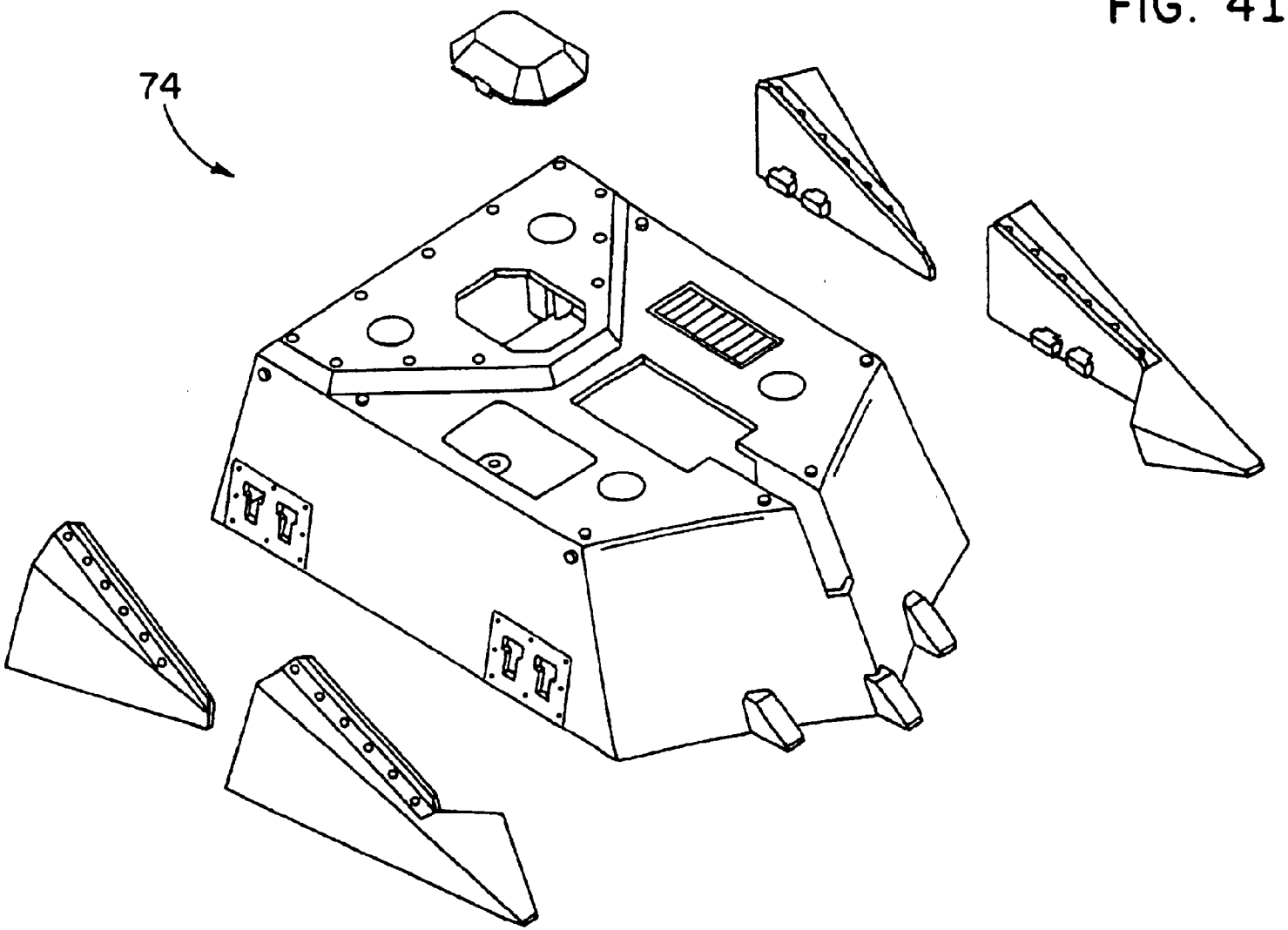
Figure 4J:
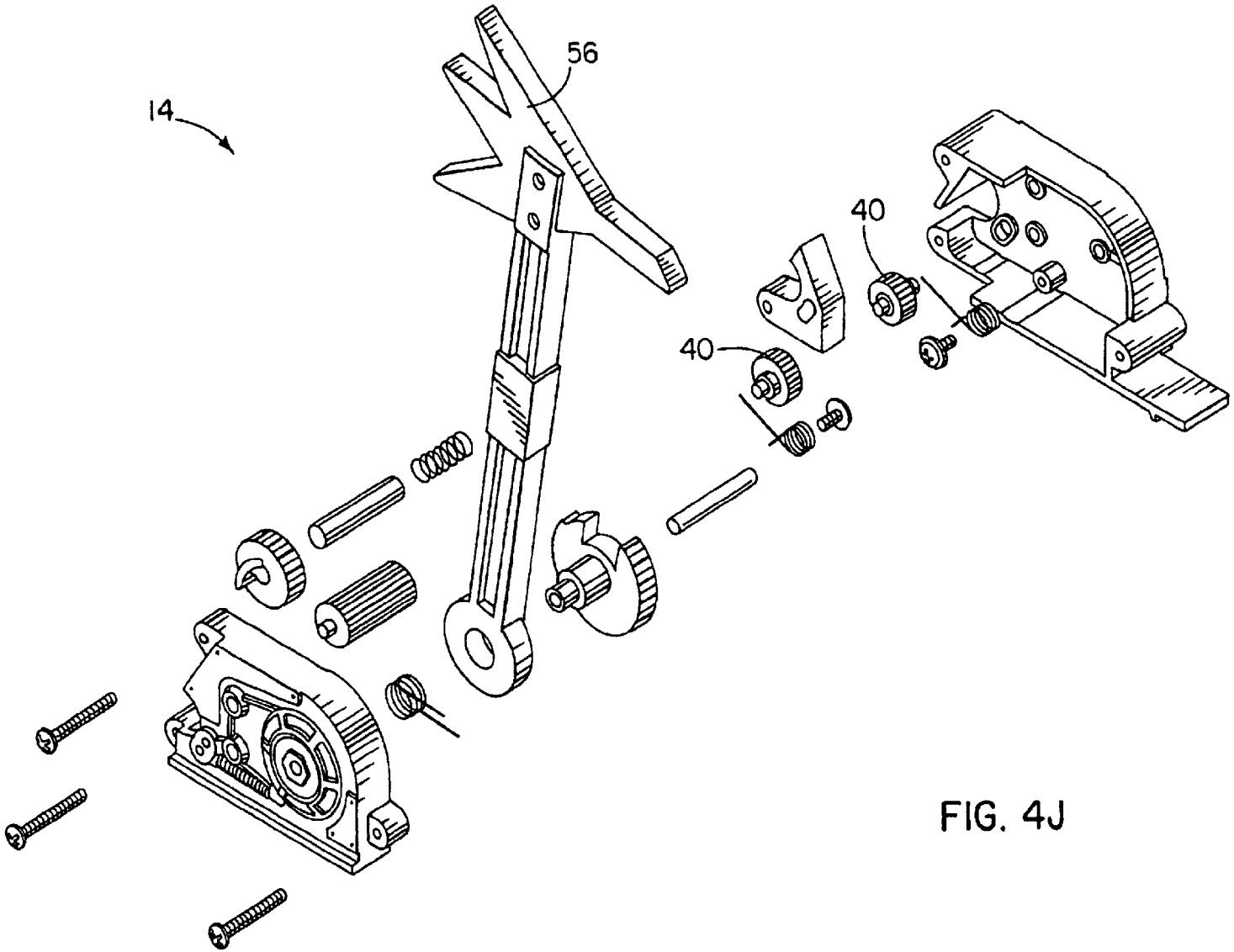
Figure 5A:
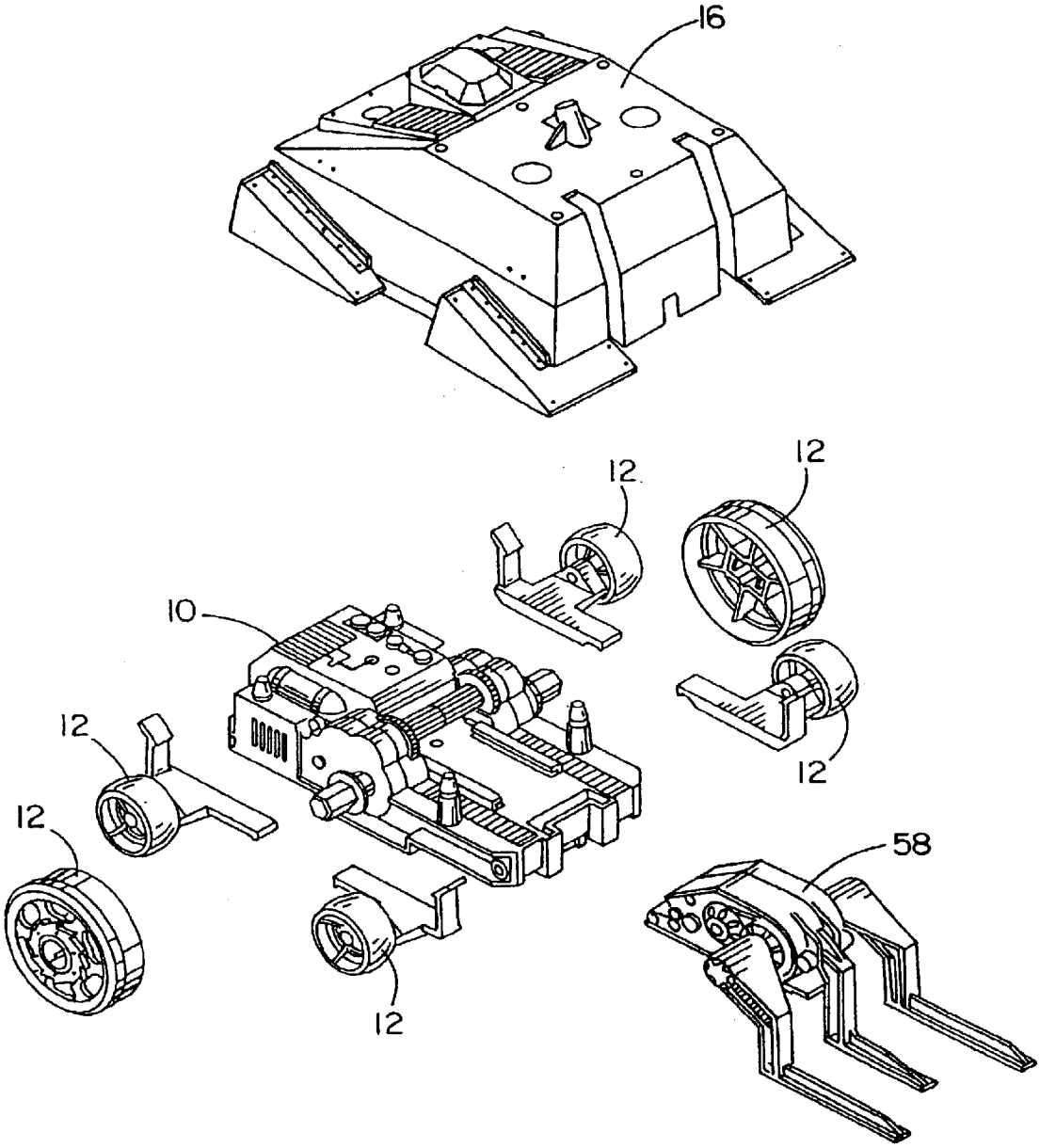
Figure 5B:
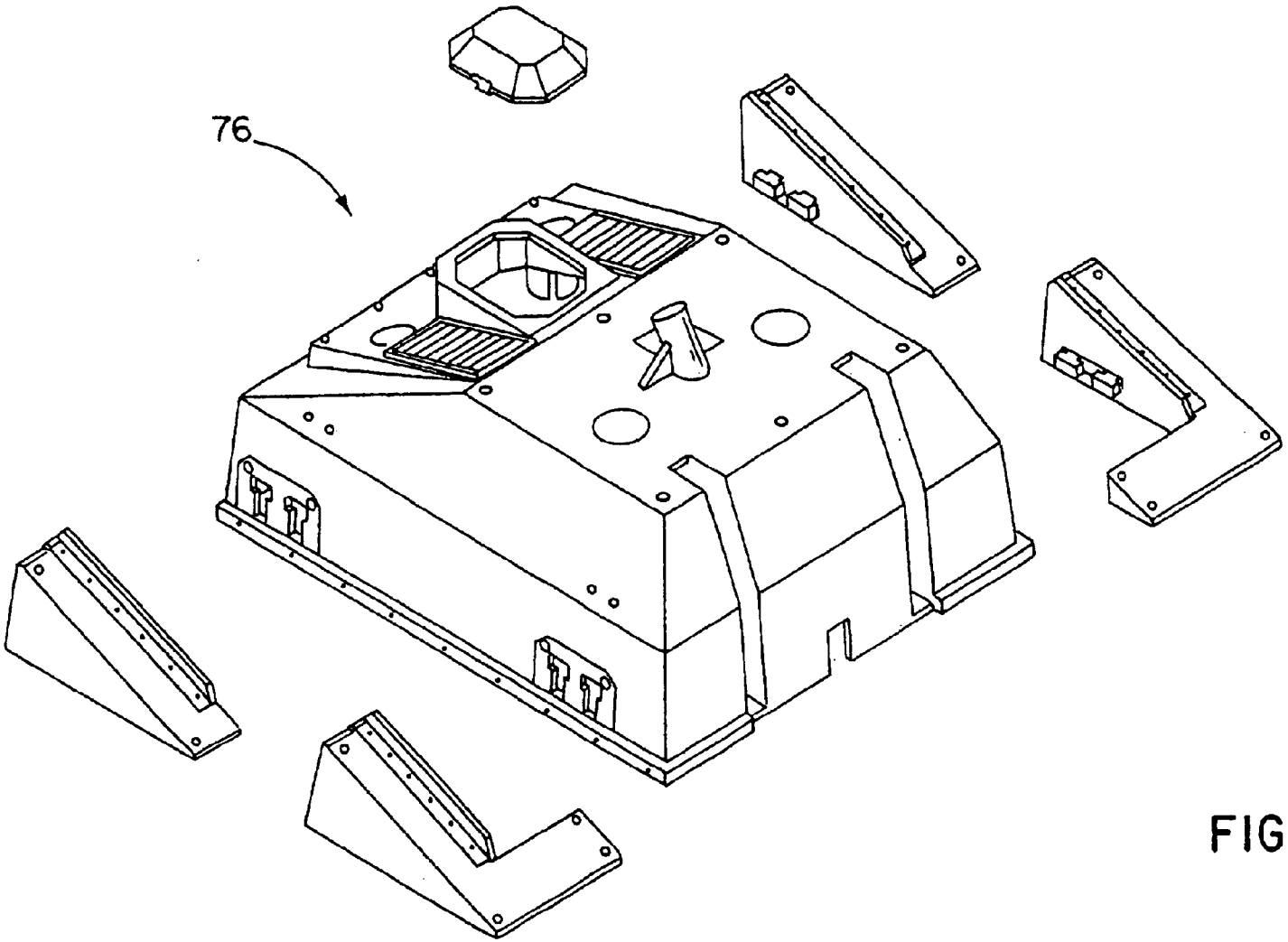
Figure 5C:
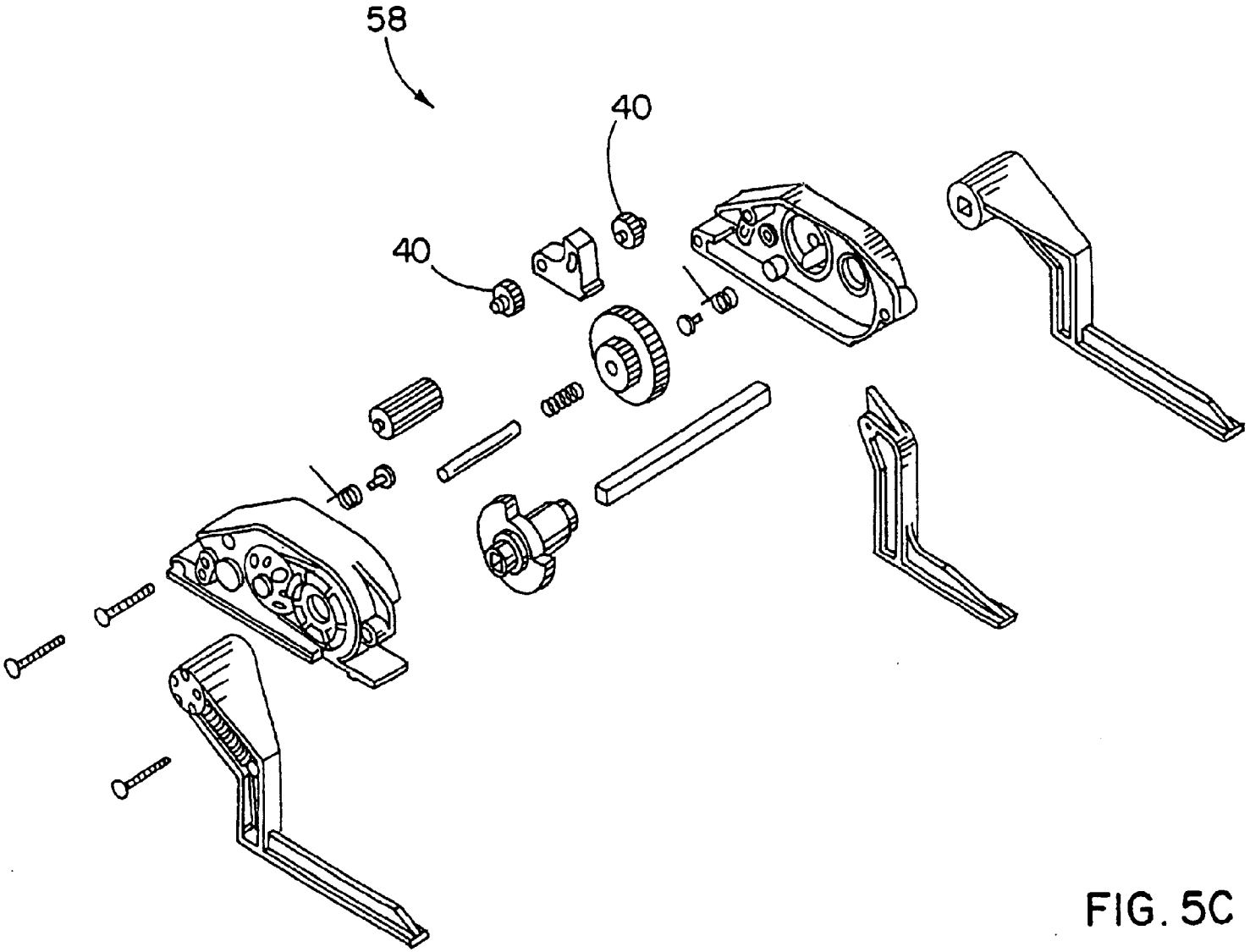
Figure 5D:
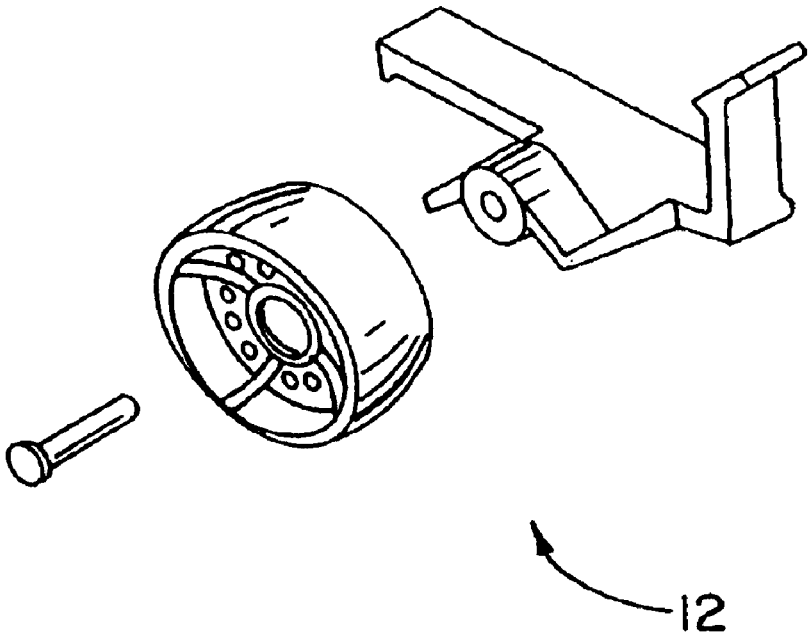
Figure 5E:
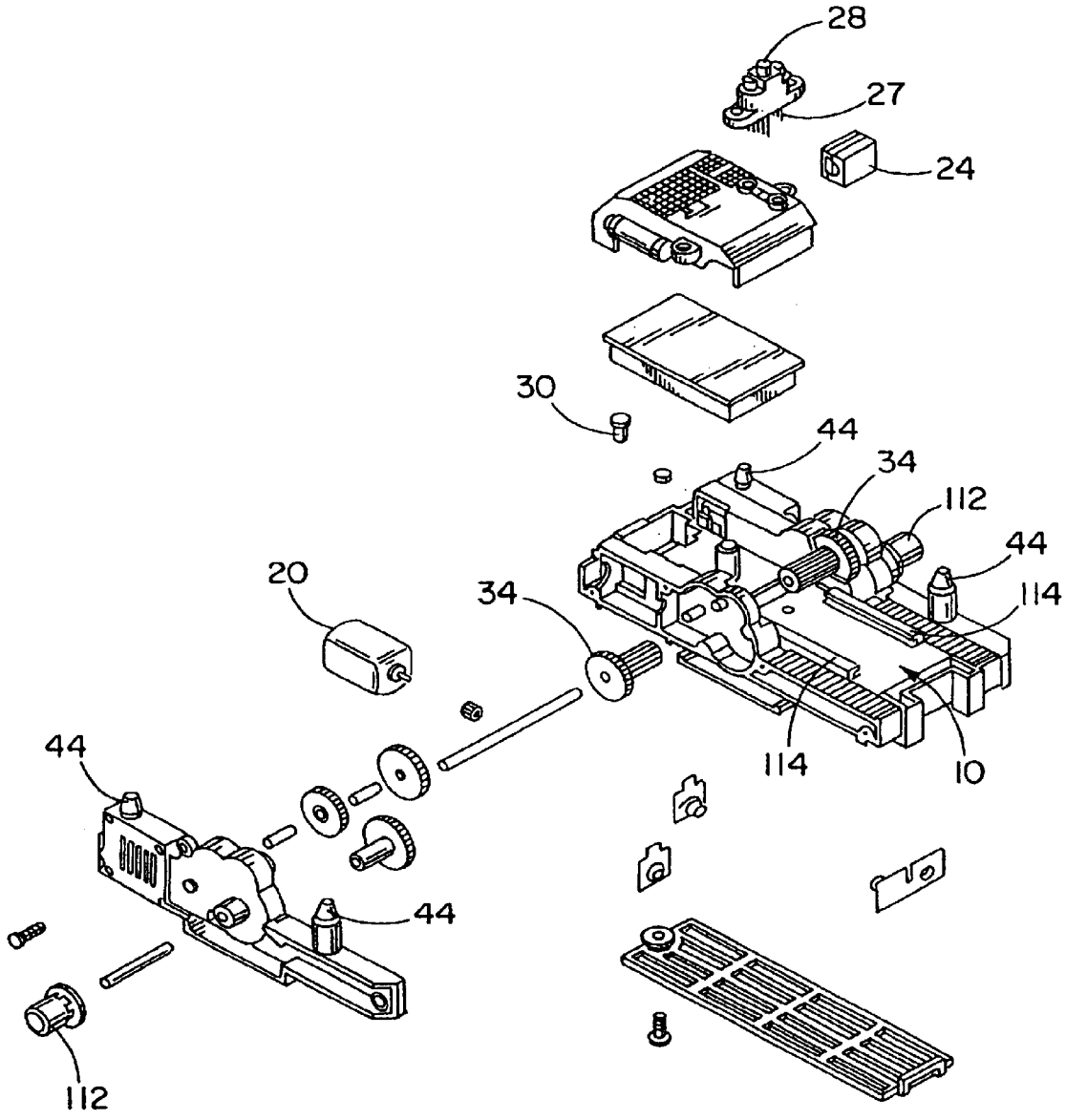
Figure 5F:
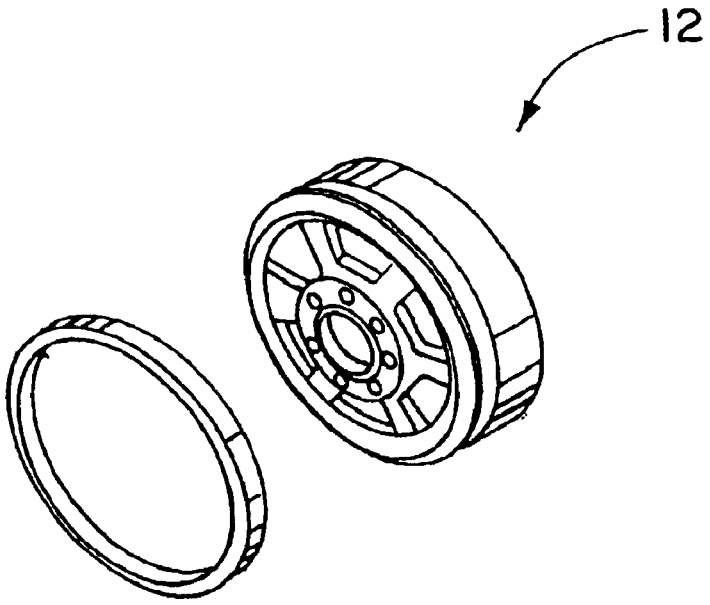
Figure 5G:
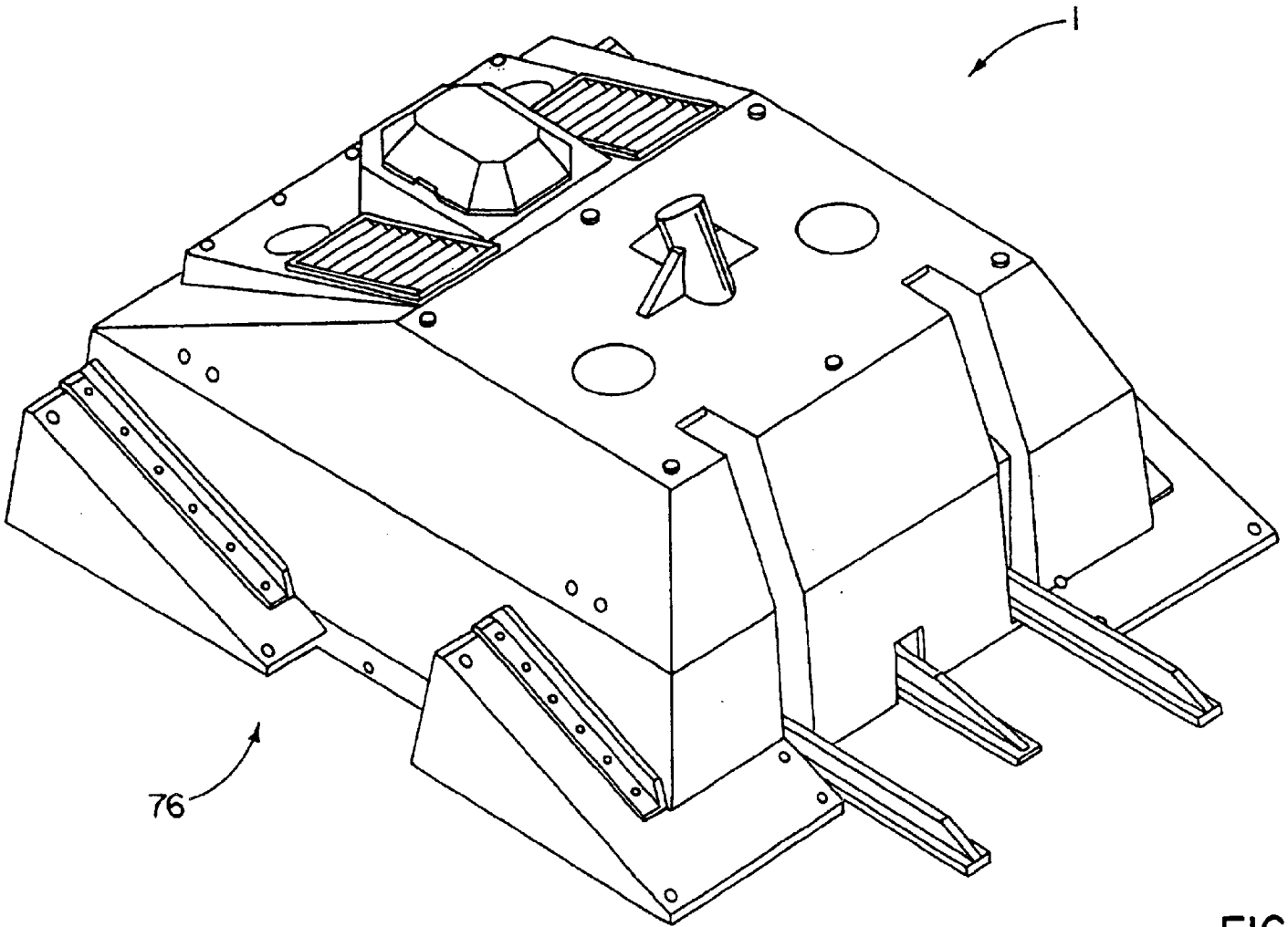
Figure 5H:
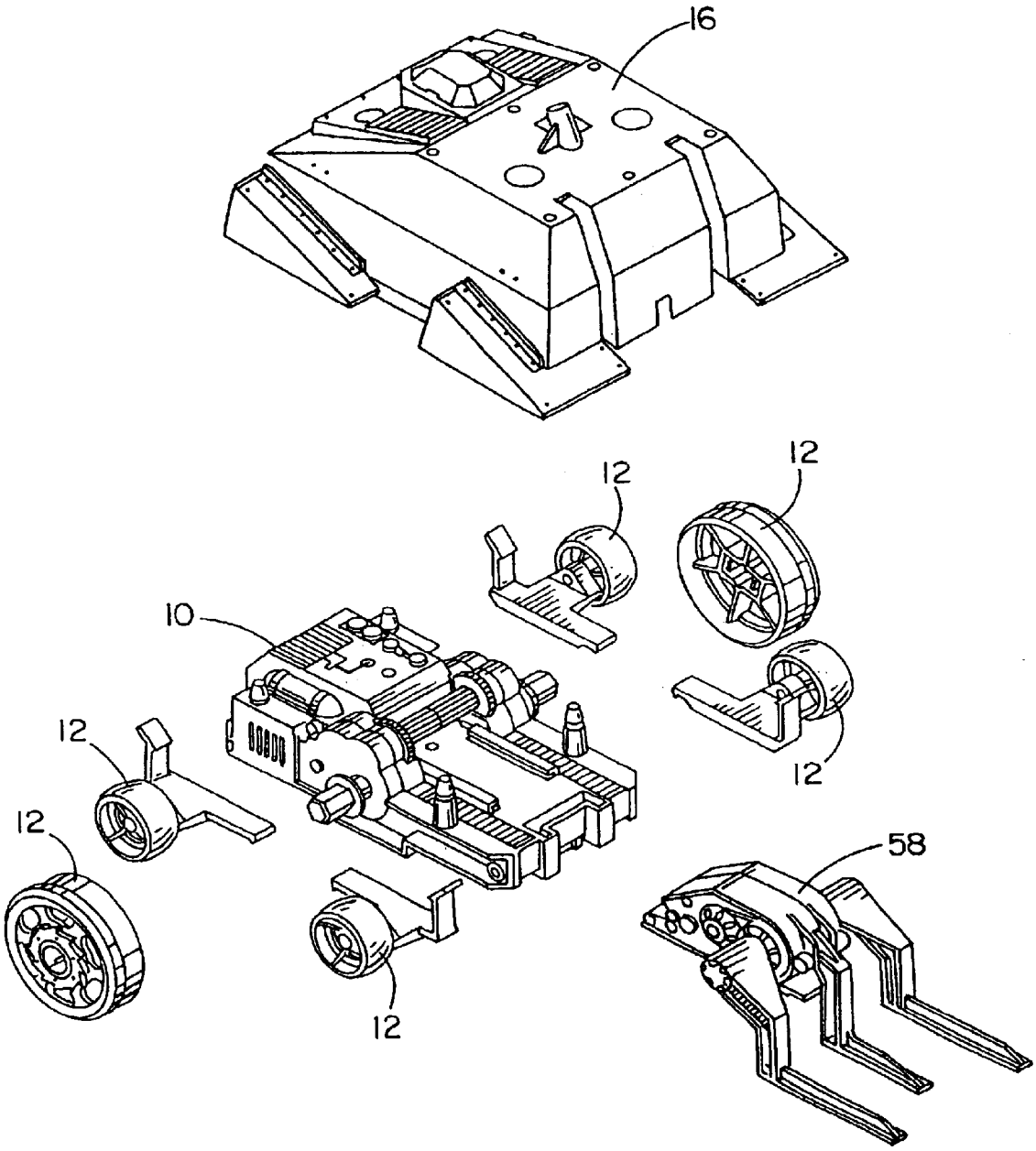
Figure 5I:
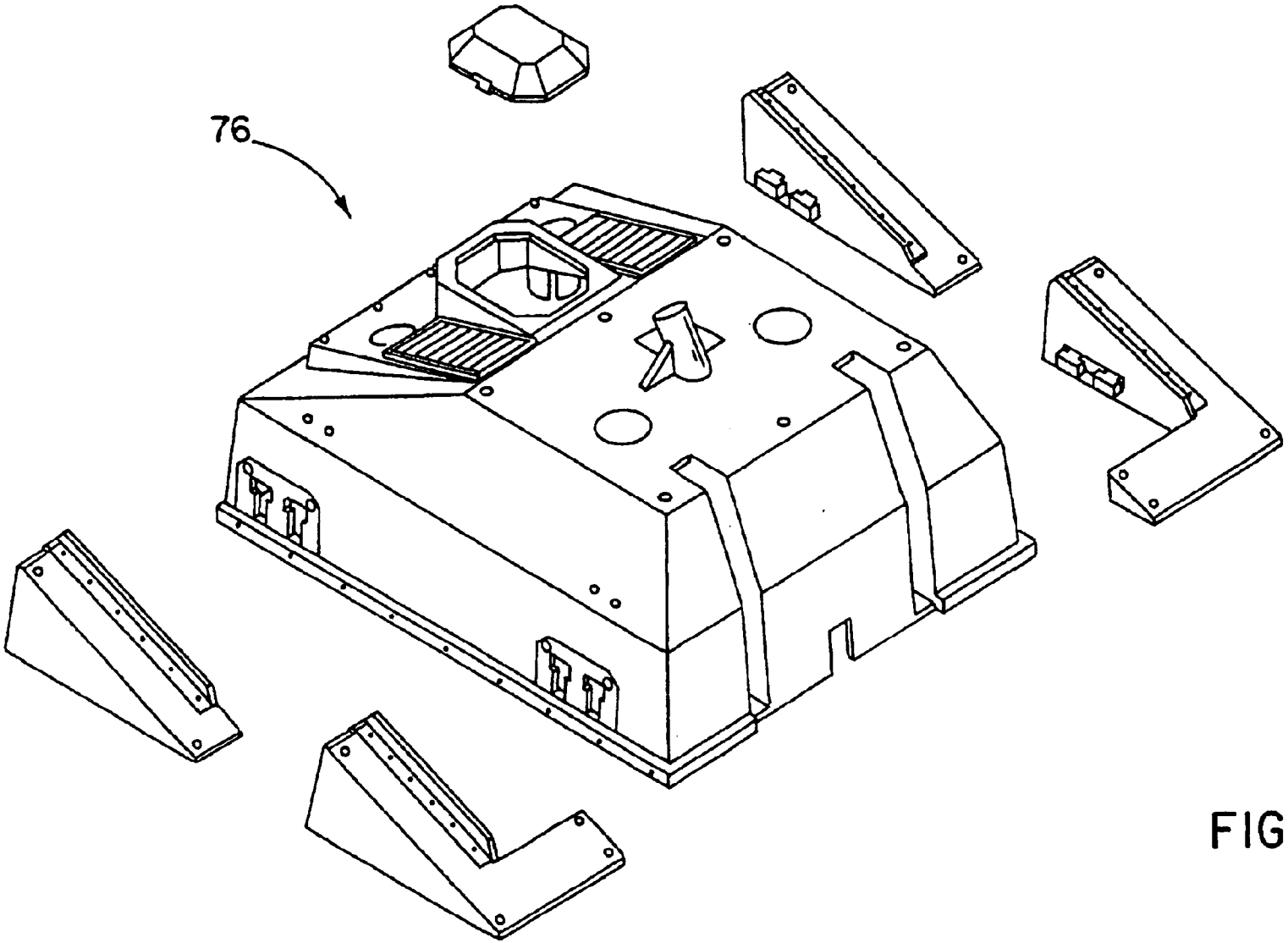
Figure 5J:
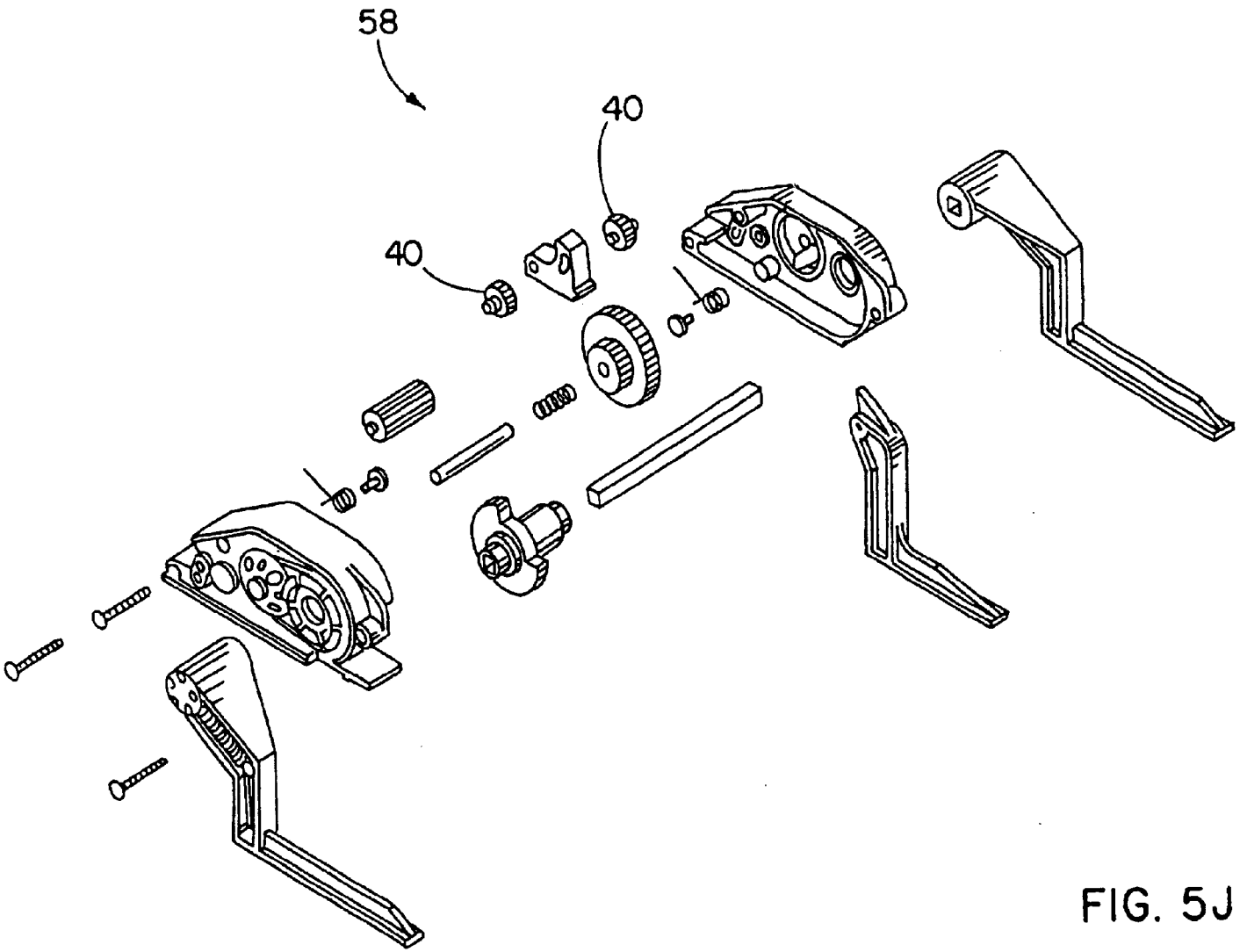

IR Battlebots 1 are described as a variety of dual motor, dual speed, remote controlled vehicles having a universal chassis 10 with the means for accepting modular wheel 112, weapon 114 and body 116 assemblies and where the chassis 10 is also equipped with the on board electronics 22 for receiving an IR signal, for controlling the speed of the motors, and for counting the number of physical impacts received. The controller 100 has the means of transmitting via IR any one of 17 codes required for the operation of the vehicles 1. These functions are forward and reverse for both motors 18, 20 and "turbo" forward and reverse for both motors 18, 20. There is also a code for when the vehicle is idle. The IR itself is broadcast at one specific carrier frequency.

Both the chassis 10 and the controller 100 may be outfitted with a switch 50 for changing the specific IR carrier broadcast frequency. The number possible switch positions is determined by the number of Battlebots 1 (chassis) required to battle simultaneously.

Alternatively, each Battlebot 1 (chassis) may be tuned to a single specific IR carrier frequency. In this event, two of the same style Battlebots (chassis) will not be able to operate simultaneously.

To clarify further, any chassis 10 may become any Battlebot 1 because of the modular nature of its construction. The modularity is purposely built in to allow users to modify their Battlebot chassis 10.

A hand-held controller 100 (not shown) is facilitated with the ability to transmit via IR signals nine codes which facilitate 17 operations of the motor as illustrated Appendix A-1 through A-8. The decoding of the 17 encoded operations for the motor drive combinations of the vehicles facilitates the functions of forward, reverse, and turbo drive commands for either or both motors including turbo forward and reverse for both motors. A code is also provided for indicating when the vehicle is in an idle state when the user has not manipulated the controls of the hand-held controller such that the vehicle motor may be provided in an OFF state. Additionally, the IR carrier frequency is broadcast by individual controllers at separate carrier frequencies allowing for the control and operation of multiple vehicles simultaneously by different users.

To this end, the controller 100 and the chassis 10 may be outfitted with a switch 50, e.g., rotatable, momentary or dip switches, for changing the specific IR broadcast frequencies. The number of possible switch positions or frequency configurations may be determined by the number of vehicles required to battle or otherwise operate simultaneously. Alternatively, each chassis may be tuned to a single specific IR carrier frequency, in which two of the same style chassis 10 may not be able to operate simultaneously.

The configured vehicles are intended for operation at relatively close range with directional infrared IR controllers 100 such that multiple players may engage in a battle or collision activity between multiple vehicles. The operation may be provided either on a tabletop or on a flat floor surface for providing a platform for engaging the play pattern as between the players and their controlled vehicles. It is likely that the players will be operating the vehicles within close range, e.g., 3 to 10 feet, preferably at a range of about six feet. As shown in FIG. 1, the universal chassis includes electronic circuitry 22 on a circuit board 26 including an IR receiver 27, impact switch 24, an LED indicator 28 and reset button 30 operable with batteries housed within the chassis. Each of two motors (left 18 and right 20) have a combination gear 34 which operates the driver train 36 and weapon subassemblies 14. As discussed, the assemblies of FIGS. 2A, 3A, 4A, and 5A facilitate operation from either of the two motors 18, 20 that will activate the weapon subassemblies 14 such that slider gears 40 in FIGS. 2J, 3J, 4J, and 5J may individually operate the mechanical subassemblies attached to the universal chassis 10.

As discussed, the universal chassis 10 accepts modular components and includes four bosses 44 to accept any of the four bodies 16, or body styles of FIGS. 2G, 3G, 4G, and 5G, identified by name by Minion 70, Blendo 72, Killerhurtz 74, and Vlad 76, body styles, respectively. The reversible motors 18, 20 are provided with two speeds either for pulsed operation from the information processor facilitated with a microprocessor 25 or microcontroller, which controls the speed by providing a pulsed or alternatively a full power ("turbo") operation. In addition to providing for slower pulsed operation, the pulsed operation of the motor also serves to extend the battery life of the vehicle, and the slow pulsed operation is also a provided mode of operation for steering or otherwise maneuvering the vehicles.

The IR controller 100 is operated on one of multiple carrier frequencies, at least three and preferably four to eight frequencies for allowing simultaneous operation, e.g., eight vehicles over eight carrier frequencies, which are controlled with a frequency configuration switch or input provided by the user. The infrared (IR) transmission link is somewhat directional with the remote hand-held controllers providing an angle of illumination of about 40 degrees allowing for multiple players in indoor closer range operation. The transmit and receive circuitries are described further below in connection with FIGS. 6 and 7A and 7B which are provided with a conventional Winbond W583 encoding circuit which transmits signals over a carrier frequency generated with a 555 timer.

The mechanical subassemblies are illustrated in exploded views for each of the four embodiments, as shown in FIGS. 2J, 3J, 4J, and 5J, respectively, providing a saw operation 52, a rotary dome with serrated teeth 54, a hatchet 56, and forklift 58 type assemblies, however, various other active assemblies may be operable from the universal chassis 10.

Figure 6:
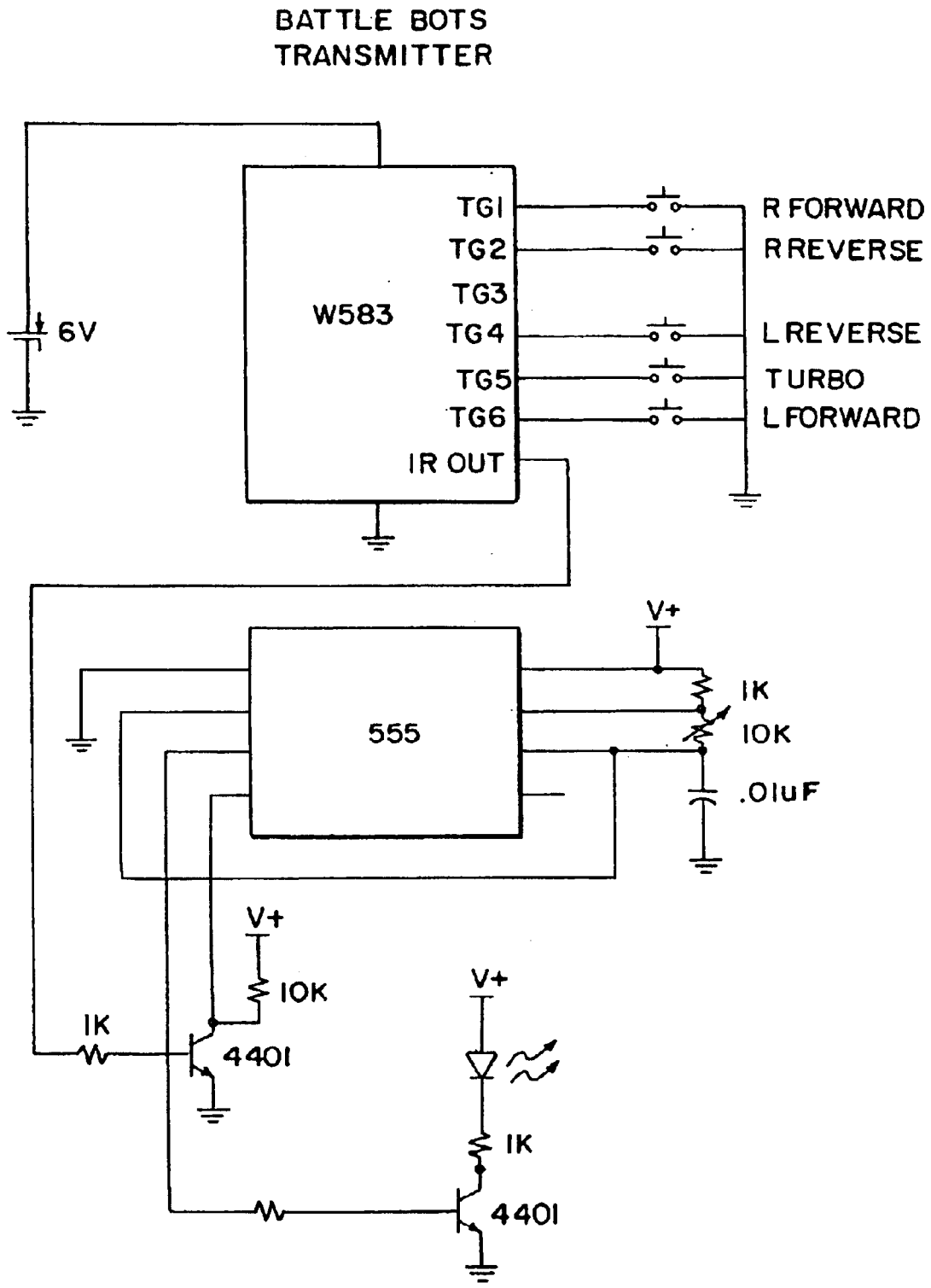
FIG. 6 is a schematic diagram of the transmitter electronics provided in a hand-held controller.
Figure 7A:
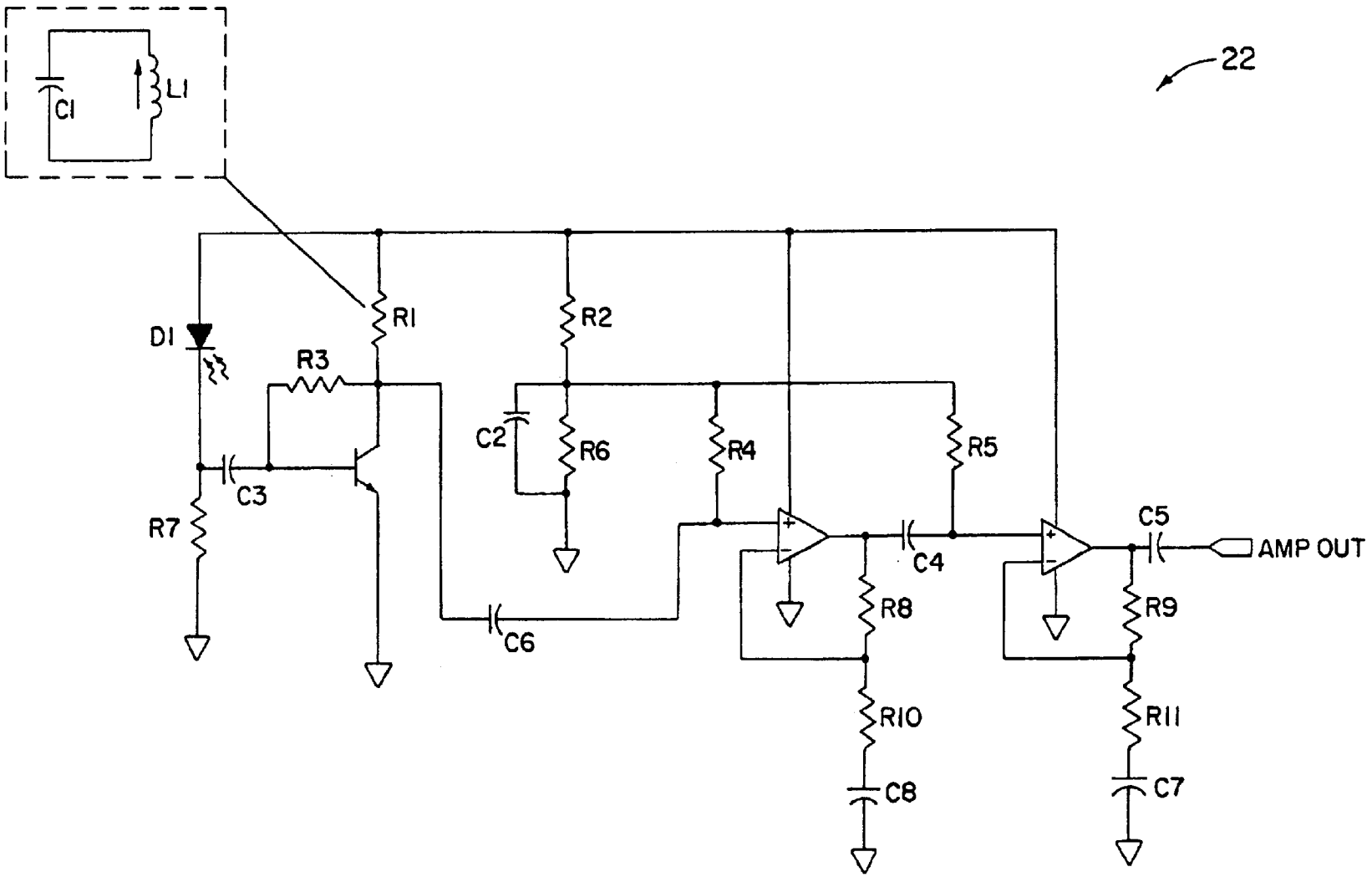
Figure 7B:
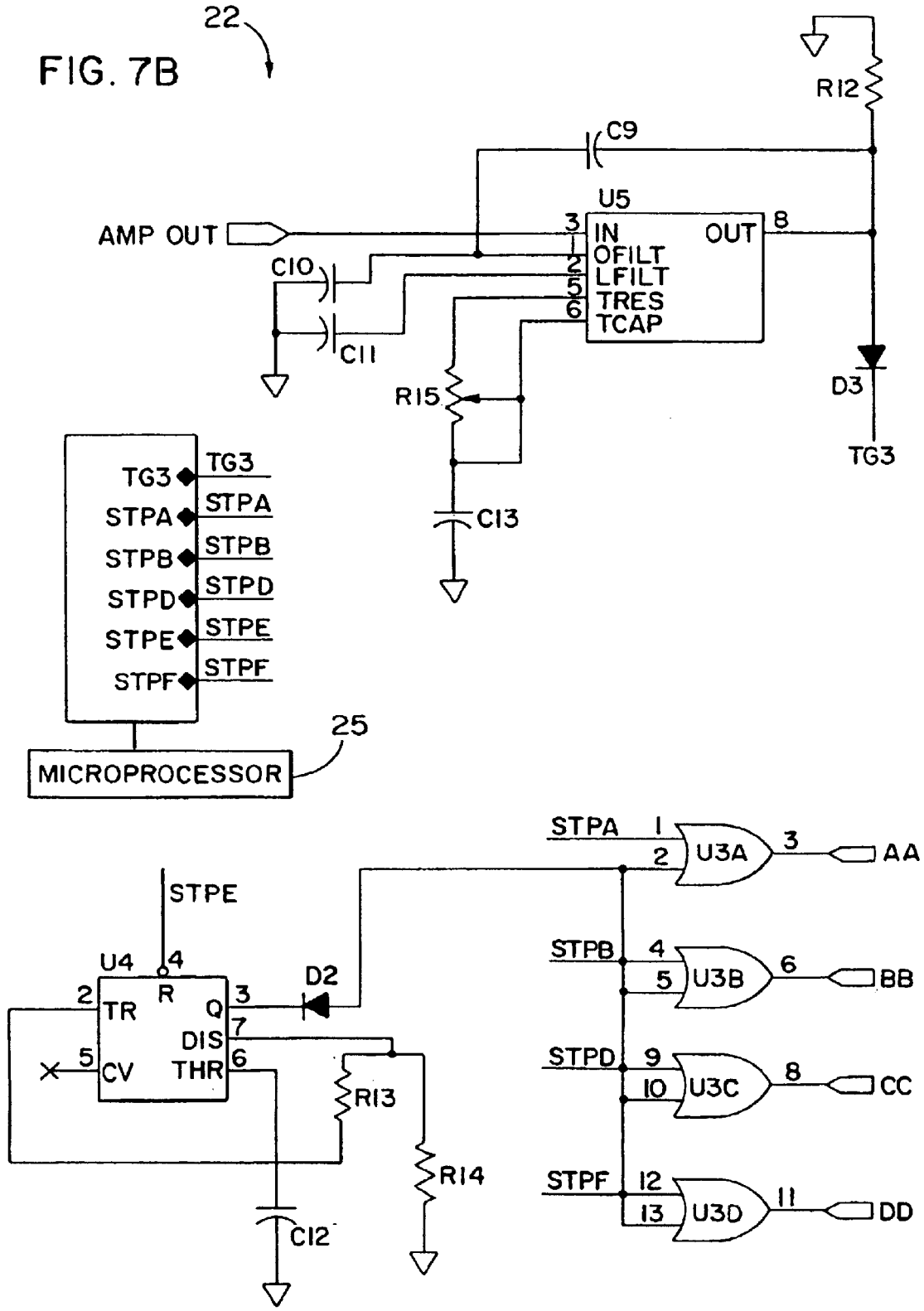

Turning now to FIG. 6, the Winbond W583 encoder circuit which is used both in the transmitter circuit of FIG. 6 and receiver circuit of FIGS. 7A and 7B, provides for modulation as indicated in the hardware IR of Appendix A-1, which is facilitated with the software control IR transmitter program of Appendix A-2 through A-5 and the IR receiver program of A-6 through A-8. As shown in FIG. 6, the IR output of the W583 integrated circuit is coupled via a transmitter to the 555 timer, which outputs a modulated carrier frequency from a IR LED under the control of a switching transistor. Codes indicated in accordance with Appendix A-1 are thus transmitted from the transmitter circuitry of FIG. 6. The typical operation for the 555 timer provides a carrier output of approximately 38 kilohertz which may be varied for operation on multiple different carriers.

Figure 7C:
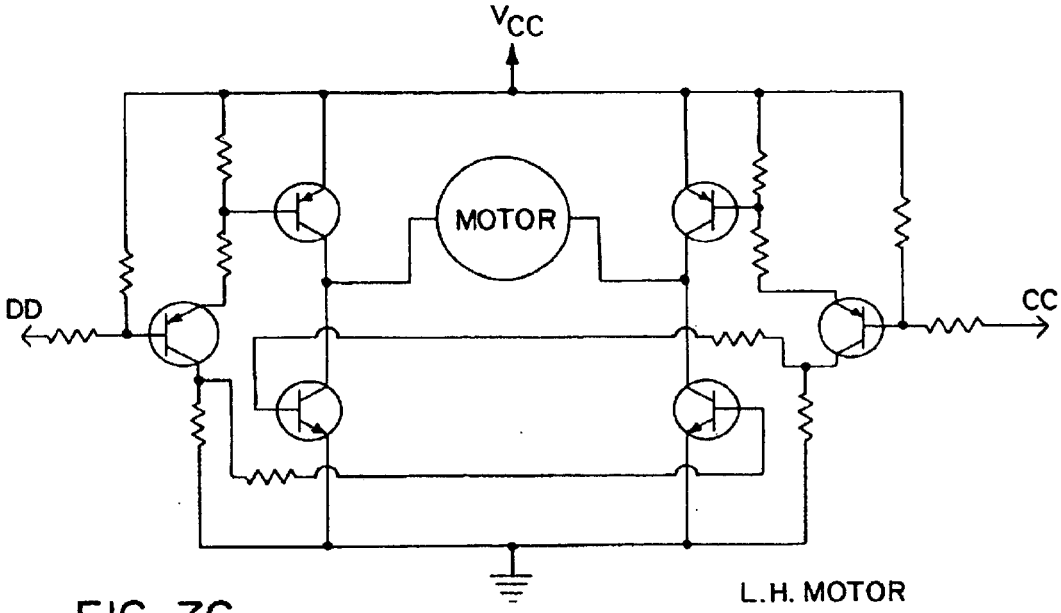
Figure 7D:
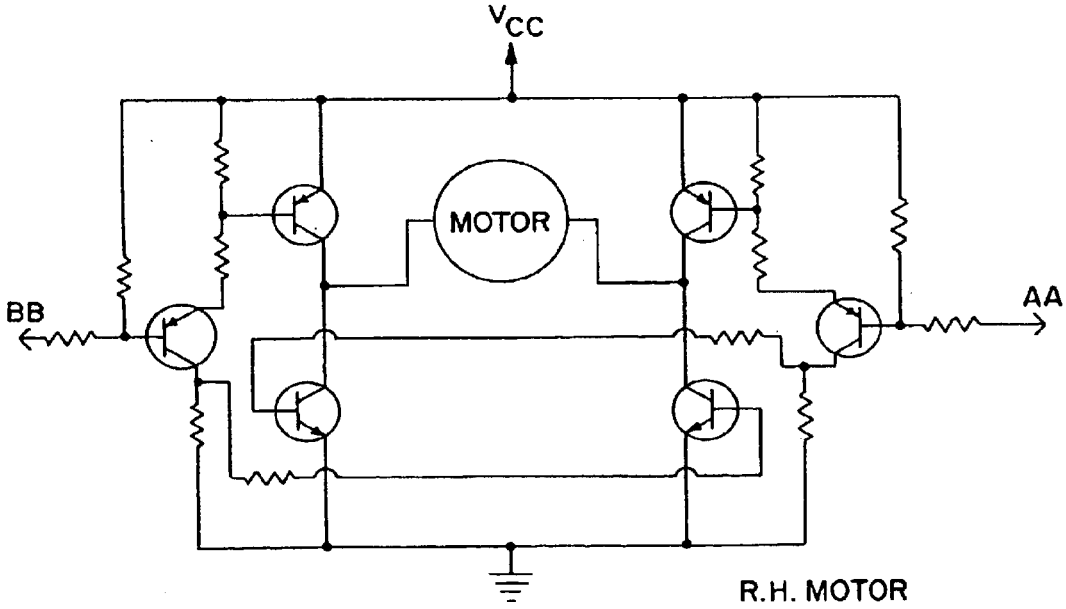

With reference to FIGS. 7A and 7B, the IR receiver includes a photo diode with a tuner adjustment stage (optional) followed by a two-stage operational amplifier for amplifying the detected IR signal which is presented to a phase-lock loop (PLL) tone decoder herein LM567 decoder which generates an output to the Winbond W583 integrated circuit for controlling the OR GATE operation of the H bridge motor circuitry of FIGS. 7C and 7D, which are provided as conventional motor drive circuits. It will be appreciated that the 555 timer of the FIGS. 7A and 7B receiver provides gated operation such that the turbo decode output resets the 555 timer so as to provide full power operation to the motors via the control circuitry of FIGS. 7C and 7D.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

APPENDIX A1

VI.12.1 H/W IR Protocol

The output protocol of hardware defined IR begins with a Start bit followed by 9 Data bits(1 data byte, MSB first, and 1 parity bit), and Stop bit. The Start bit is typically composed of 1 mS High(TH) and 6.5 mS Low(TL). Data bit '1' is composed of 1 mS High and 4 mS Low. Data bit '0' and Stop bit are composed of 1 mS High and 2 mS Low. It's called pulse position modulation. The IROUT pin will keep high in TH duration and output 38 KHz carrier with 75% duty cycle in TL duration. Receiver module will recover the original waveform by filtering the 38 KHz carrier out.

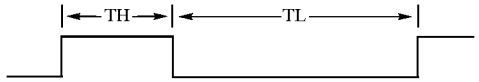

| Parameter | Description | Min. | Typ. | Max. | Unit |
|---|---|---|---|---|---|
| TD0 | Data "0" period | | 3000 | | μS |
| THD0 | Data "0" high time | 800 | 1000 | 1200 | μS |
| TLD0 | Data "0" low time | 1600 | 2000 | 2400 | μS |
| TD1 | Data "1" period | | 5000 | | μS |
| THD1 | Data "1" high time | 800 | 1000 | 1200 | μS |
| TLD1 | Data "1" low time | 3200 | 4000 | 4800 | μS |
| TSTR | Start bit period | | 7500 | | μS |
| THSTR | Start bit high time | 800 | 1000 | 1200 | μS |
| TLSTR | Start bit low time | 5200 | 6500 | | μS |

APPENDIX A2

```
;       Battle Bots
;
;       BBot_T2      IR transmitter program
;
;
;
;
        W583S40
            DEFPAGE 1
        NORMAL
            OSC_3MHZ
            VOUT_DAC
            LED0
            FREQ2
32:
            LD EN0,10111011b
        LD EN1,00110011b
            LD R0,0
        LD MODE0,10111111B    ;STP C control IR
        LD MODE1,0FEH         ;IR carrier disabled
        END

0:      ;TG1 is low
        ;ignore TG2
        [10]
        JP 40@TG6_LOW
        JP 41@TG4_LOW
        JP 42@TG5_LOW
;       LD STOP,11111011b
;       [500]
;       LD STOP,11111111b
;       [500]
;       LD STOP,11111011b
;       [500]
;       LD STOP,11111111b
;       [500]
;       LD STOP,11111011b
;       [500]
;       LD STOP,11111111b
;       [500]
;       LD STOP,11111011b
;       [500]
;       LD STOP,11111111b
;       [500]
        LD R0,33              ;left turn
        JP 110
1:      ;ignore TG1
        ;TG2 is low
        [10]
        JP 45
9:      ;TG6 is low
        ;ignore TG4
        [10]
        JP 40@TG1_LOW
        JP 49@TG2_LOW
        JP 46
3:      ;ignore TG6
```

APPENDIX A3

```
        TG4 is low
        [10]
        JP 41@TG1_LOW
        JP 50@TG2_LOW
        JP 47
4:      ;TG1 returns high
        [10]
        JP 45@TG2_LOW
        JP 46@TG6_LOW
        JP 47@TG4_LOW
        LD R0,49              ;stop
        JP 110
5:      ;TG2 returns high
        [10]
        JP 0@TG1_LOW
        JP 46@TG6_LOW
        JP 47@TG4_LOW
        LD R0,49              ;stop
```

-continued

```
        JP 110
13:     ;TG6 returns high
        [10]
        JP 0@TG1_LOW
        JP 45@TG2_LOW
        JP 47@TG4_LOW
        LD R0,49              ;stop
        JP 110
7:      ;TG4 returns high
        [10]
        JP 0@TG1_LOW
        JP 45@TG2_LOW
        JP 46@TG6_LOW
        LD R0,49              ;stop
        JP 110
8:      ;TG5 is low
        [10]
        JP 0@TG1_LOW
        JP 45@TG2_LOW
        JP 46@TG6_LOW
        JP 47@TG4_LOW
        LD R0,49              ;stop
        JP 110
12:     ;TG5 returns high
        [10]
        JP 0@TG1_LOW
        JP 1@TG2_LOW
        JP 9@TG6_LOW
        JP 3@TG4_LOW
        LD R0,49              ;stop
        JP 110
40:     ;TG1 is low
        ;TG6 is low
        JP 43@TG5_LOW
        LD R0,40              ;forward
        JP 110
41:     ;TG1 is low
        ;TG4 is low
        JP 44@TG5_LOW
        LD R0,37              ;ccw spin
```

APPENDIX A4

```
        JP 110
42:     ;TG1 is low
        ;TG5 is low
        LD RO,41              ;turbo left turn
        JP 110
43:     ;TG1 is low
        ;TG6 is low
        ;TG5 is low
        LD R0,48              ;turbo forward
        JP 110
44:
        LD R0,45              ;turbo ccw spin
        JP 110
45:     ;TG2 is low
        JP 49@TG6_LOW
        JP 50@TG4_LOW
        JP 51@TG5_LOW
        LD R0,34              ;reverse left turn
        JP 110
46:     ;TG1 is high
        ;TG2 is high
        ;TG6 is low
        JP 54@TG5_LOW
        LD R0,35              ;right turn
        JP 110
47:     ;TG1 is high
        ;TG2 is high
        ;TG6 is high
        ;TG4 is low
        JP 55@TG5_LOW
        LD R0,36              ;reverse right turn
        JP 110
48:     ;TG1 is high
        ;TG2 is high
        ;TG6 is high
        ;TG4 is high
        ;TG5 is low
```

-continued

```
        LD R0,49                ;stop
        JP 110
49:     ;TG2 is low
        ;TG6 is low
        JP 52@TG5_LOW
        LD R0,38                ;cw spin
        JP 110
50:     ;TG2 is low
        ;TG4 is low
        JP 53@TG5_LOW
        LD R0,39                ;reverse
        JP 110
51:     ;TG2 is low
        LD R0,42                ;turbo reverse left turn
        JP 110
52:     ;TG2 is low
        ;TG6 is low
        ;TG5 is low
        LD R0,46                ;turbo cw spin
```

APPENDIX A5

```
        JP 110
53:     ;TG2 is low
        ;TG4 is low
        ;TG5 is low
        LD R0,47                ;turbo reverse
        JP 110
54:     ;TG1 is high
        ;TG2 is high
        ;TG6 is low
        ;TG5 is low
        LD R0,43                ;turbo right turn
        JP 110
55:     ;TG1 is high
        ;TG2 is high
        ;TG6 is high
        ;TG4 is low
        ;TG5 is low
        LD R0,44                ;turbo reverse right turn
        JP 110
110:
        [300]
        TX R0
        [100]
        TX R0
                ;[1000]
        [400]
        JP 110
2:
60:
100:
10:
11:
6:
14:
15:
. . .
255:
        jp 32
```

APPENDIX A6

```
;       Battle Bots
;
;       BBOT_R2     IR receiver program
;
;
;
;
W583S40
DEFPAGE 1
NORMAL
OSC_3MHZ
VOUT_DAC
LED0
FREQ2       ;8KHZ
POI:
            LD EN0,0
            LD EN1,0
;             LD MODE0,0bFH
```

-continued

```
;       LD MODE0,00111111b      ;led1 DC,stpc output
        LD MODE0,00101111b      ;led1 DC,stpc output,short debounce
;           LD MODE1,0FFH
        LD MODE1, 11111111b
;           LD STOP,0FFH
          LD STOP,07FH
        LED1      ;;led1 on
          [400]
;           LD EN0,00H
        LD EN1,00001000b        ;TG8 negative edge triggered for
                                jiggle switch
;       LD EN1,00000000b        ;TG8 negative edge triggered for
                                jiggle switch
DISABLED
        LD R0,50
          JP 100
11:
        JP R0
100:
          [880]
        LD STOP,01111111b
        JP 101
        END
101:
          [880]
        LD STOP,01111111b
        JP 102
        END
102:
          [880]
        LD STOP,01111111b
        JP 103
        END
103:
          [880]
        LD STOP,01111111b
        JP 104
        END
104:
```

APPENDIX A7

```
          [880]
        LD STOP,01111111b
        JP 105
        END
105:
          [880]
        LD STOP,01111111b
        JP 106
        END
106:
          [880]
        LD STOP,01111111b
        JP 107
        END
107:
          [880]
        LD STOP,01111111b
        JP 108
        END
108:
          [880]
        LD STOP,01111111b
        JP 109
        END
109:
          [880]
        LD STOP,01111111b
          JP 100
        END
33:
        LD STOP,01111110b
        JP 100
34:
        LD STOP,01111101b
        JP 100
35:
        LD STOP,01011111b
        JP 100
```

-continued

```
36:
    LD STOP,01110111b
    JP 100
37:
    LD STOP,01110110b
    JP 100
38:
    LD STOP,01011101b
    JP 100
39:
    LD STOP,01110101b
    JP 100
40:
    LD STOP,01011110b
    JP 100
41:
    LD STOP,01101110b
    JP 100
```

APPENDIX A8

```
42:
    LD STOP,01101101b
    JP 100
43:
    LD STOP,01001111b
    JP 100
44:
    LD STOP,01100111b
    JP 100
45:
    LD STOP,01100110b
    JP 100
46:
    LD STOP,01001101b
    JP 100
47:
    LD STOP,01100101b
    JP 100
48:
    LD STOP,01001110b
    JP 100
49:
    LD STOP,01111111b
    JP 100
50:
    LD EN1,00000000b        ;disable all triggers
    LD STOP,11111111b ;disable IR input - npn base hi . . . npn on!
    LD R0,51
    LED1
    [1000]
    LD STOP,01111111b
    LD EN1,00001000b        ;TG8 negative edge triggered
                            for jiggle switch
    JP 100
51:
    LD EN1,00000000b        ;disable all triggers
    LD STOP,11111111b ;disable IR input - npn base hi . . . npn on!
    LD R0,52
    LD MODE0,10111111b      ;led1 flash
    LED1
    [1000]
    LD STOP,01111111b
    LD EN1,00001000b        ;TG8 negative edge triggered for
                            jiggle switch
    JP 100
52:
    LD EN1,00000000b        ;disable all triggers
    LD STOP,11111111b ;disable IR input - npn base hi . . . npn on!
    LED0                    ;led1 off
53:
    JP 53
```

What is claimed is:

1. A universal chassis, comprising:

an information processor for controlling the functionality of the chassis;

means for accepting a variety of snap-on mechanical subassemblies;

means for receiving communication signals for controlling said information processor;

at least one motor operable by said information processor;

means for detecting impacts, said detecting means allowing for the counting of the impacts by the information processor;

means for powering said snap-on mechanical subassemblies from said one or more motors; and means for detecting the presence or absence of a mechanical subassembly.

2. The universal chassis as recited in claim 1 wherein said at least one motor comprises two processor controlled pulsed motors for two speed performance and said powering means comprises means for clutching the output drive gears of either pulsed motor for powering the mechanical subassembly.

3. The universal chassis as recited in claim 2 further comprising means for connecting removable accessory body parts.

4. The universal chassis as recited in claim 3 wherein said mechanical subassemblies comprise:

means for connecting to the chassis;

means to transfer power from either motor in the chassis to the mechanical subassembly;

spring loaded gear means for actuating a mechanical subassembly comprising hammer or fork lift components;

means for rotating the entire vehicle body or any other attachment; and means for spinning an extended sawblade or other mechanical subassembly.

5. The universal chassis as recited in claim 2 operable with a controller, said controller comprising:

means to transmit a single carrier frequency;

means to transmit a multiplicity of codes over the carrier frequency;

switch means to change the transmitted carrier frequency;

means to control both motors in the chassis; and means to control the two speed performance.

6. The universal chassis of claim 1 further comprising means for displaying the counted number of impacts.

7. A universal chassis capable of accepting a variety of snap-on components, comprising: a chassis;

an information processor for controlling the functionality of the chassis;

an actuator gear mounted on said chassis;

at least one motor operable by said information processor for controlling said actuator gear, said information processor detecting the presence or absence of a mechanical assembly of a snap-on component engaged with said actuator gear for operation by said at least one motor;

a receiver in communication with said information processor; and a carrier selector for controlling the communication signals receivable at said receiver.

8. The universal chassis as recited in claim 7 wherein said radio frequency carrier selector comprises a multiple position switch facilitating the simultaneous communication with said receiver and a second receiver associated with a second chassis.

9. The universal chassis as recited in claim 8 comprising a second motor operable by said information processor for maneuvering said chassis.

10. The universal chassis as recited in claim 9 wherein each of said motors are individually operable for left and right operation for steering or otherwise maneuvering said chassis.

11. The universal chassis as recited in claim 10 wherein said actuator gear mounted on said chassis comprises an interlock or clutch mechanical subassembly in communication with a gear for operation of the snap-on component.

12. A playset including remote controlled interactive vehicles having universal chassis assemblies, the playset comprising:

a plurality of transmitters each comprising a transmission carrier selector for controlling communication signals transmittable from said transmitters;

a plurality of vehicle chassis assemblies, each comprising: an information processor associated with each said vehicle chassis for controlling the functionality of respective vehicles;

at least one motor operable by each respective information processor for controlling the maneuvering of the vehicles;

a receiver in communication with each said information processor; and a carrier selector for controlling the communication signals receivable at said receiver associated with each vehicle, wherein a receiver carrier selector facilitates communication between transmitter-receiver pairs for individual operation of vehicle receivers simultaneously with other vehicles.

13. The playset as recited in claim 12 wherein each chassis comprises art actuator gear mounted thereon and operable by said at least one motor with said information processor detecting the presence or absence of a mechanical assembly of a snap-on component engaged with said actuator linkages for operation by said at least one motor.

* * * * *